US006483395B2

(12) United States Patent
Kasai et al.

(10) Patent No.: US 6,483,395 B2
(45) Date of Patent: Nov. 19, 2002

(54) MICRO-MACHINE (MEMS) SWITCH WITH ELECTRICAL INSULATOR

(75) Inventors: Shigeru Kasai, Tokyo (JP); Kenichirou Suzuki, Tokyo (JP); Yoshinori Ota, Iwate (JP); Tatsumi Ide, Iwate (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/809,975

(22) Filed: Mar. 16, 2001

(65) Prior Publication Data

US 2001/0022541 A1 Sep. 20, 2001

(30) Foreign Application Priority Data

Mar. 16, 2000 (JP) ..... 2000-073469

(51) Int. Cl.[7] ..... H01P 1/10
(52) U.S. Cl. ..... 333/105; 333/262; 200/181
(58) Field of Search ..... 333/105, 262, 333/106, 107, 101; 200/181

(56) References Cited

U.S. PATENT DOCUMENTS 5,619,061 A * 4/1997 Goldsmith et al. ..... 257/528
5,638,946 A * 6/1997 Zavracky ..... 200/181
5,880,921 A * 3/1999 Tham et al. ..... 333/262
6,232,847 B1 * 5/2001 Marcy et al. ..... 331/117 R

FOREIGN PATENT DOCUMENTS

| | | |
|---|---|---|
| JP | 9017300 | 1/1997 |
| JP | 9147720 | 6/1997 |
| JP | 9269336 | 10/1997 |

* cited by examiner

*Primary Examiner*—Robert Pascal
*Assistant Examiner*—Dean Takaoka
(74) *Attorney, Agent, or Firm*—Katten, Muchin, Zavis, Rosenman

(57) ABSTRACT

A micro-machine switch which causes a contact electrode to make contact with or separate away from a signal line formed on a substrate, to thereby turn on or off the signal line, includes (a) first to N-th lower electrodes formed on the substrate, wherein N is an integer equal to or greater than 2, (b) first to N-th upper electrodes supported facing the first to N-th lower electrodes, respectively, and (c) an electrode supporter for vertically raising and lowering the first to N-th upper electrodes between a first position where the contact electrode makes contact with the signal line when electrostatic force is generated between the first to N-th upper electrodes and the first to N-th lower electrodes, respectively, and a second position where the contact electrode is separated away from the signal line when the electrostatic force is not generated.

42 Claims, 12 Drawing Sheets

F1 : FORCE AT WHICH CONTACT ELECTRODE MAKES CONTACT WITH SIGNAL LINE

F2 : FORCE AT WHICH CONTACT ELECTRODE IS SEPARATED AWAY FROM SIGNAL LINE

MICRO-MACHINE (MEMS) SWITCH WITH ELECTRICAL INSULATOR

BACKGROUND OF THE INVENTION

1. Field of the Invention

The invention relates to a micro-machine mems switch, with electrical insulator and more particularly to a micro-machine switch used for opening and closing an electric contact.

2. Description of the Related Art

As one of conventional micro-machine switches, the micro-machine switch suggested in Japanese Unexamined Patent Publication No. 9-17300, which is based on the U.S. patent application Ser. No. 08/493,445 filed on Jun. 22, 1995 and assigned to Rockwell International Corporation, is illustrated in FIGS. 1A and 1B. FIG. 1A is a plan view of the same, and FIG. 1B is a cross-sectional view taken along the line 1B—1B in FIG. 1A.

An anchor 114 composed of thermosetting polyimide, a lower electrode 116 composed of gold, and a signal line 118 composed of gold are formed on a substrate 112 composed of GaAs.

A cantilever arm 120 supported at one end on the anchor 114 extends beyond the lower electrode 116 and to the signal line 118, and faces both the lower electrode 116 and the signal line 118 with a spatial gap therebetween. The cantilever arm 120 is comprised of silicon dioxide films.

An upper electrode 124 composed of aluminum is formed on the cantilever arm 120, extending from the anchor 114 to the lower electrode 116.

A contact electrode 122 composed of gold is formed on a lower surface of the cantilever arm 120 in alignment with the signal line 118.

The signal line 118 faces the contact electrode 122 with a gap therebetween. Accordingly, when no voltage is applied to the micro-machine switch, no current runs through the signal line 118.

On application of a voltage of 30V across the upper electrode 124 and the lower electrode 116, there is generated electrostatic force which pulls the upper electrode 124 towards the substrate 112. Hence, the cantilever arm 120 is downwardly deformed, resulting in that the contact electrode 122 makes contact with the signal line 118, and accordingly, a current runs through the signal line 118.

Thus, it is possible to make a current run through the signal line 118 or stop a current from doing the same by applying a voltage across the upper electrode 124 and the lower electrode 116 or stopping application of the voltage.

However, the conventional micro-machine switch 110 illustrated in FIGS. 1A and 1B is accompanied with the following problems.

When the cantilever arm 120 is deformed towards the substrate 112, the contact electrode 122 located at a distal end of the cantilever 120 first makes contact with the signal line 118, and then, the upper electrode 124 is attracted towards the lower electrode 116. In this situation, a force is applied to the cantilever arm 120 at a proximal end, and not at a distal end of the cantilever arm 120.

As a result, the contact electrode 122 does not make parallel contact with the signal line 118, but makes contact with the signal line 118 at a certain angle. That is, the contact electrode 122 makes contact with the signal line 118 only in a certain area. This causes non-uniformity in a contact resistance of the signal line 118, and degrades an area at which the contact electrode 122 makes contact with the signal line 118, in a lifetime test in which a load is applied to the signal line 118.

That is, the first problem is remarkable deterioration in contact performance.

In the micro-machine switch 110 having a structure where a force is applied to the cantilever arm 120 at a proximal end thereof to thereby cause the contact electrode 122 to make contact with the signal line 118, it is considered that the contact electrode 122 slides relative to the signal line 118. The slide movement between the contact electrode 122 and the signal line 118 increases an adhesive force generated therebetween in dependence on materials of which the contact electrode 122 and the signal line 118 are composed and a contact force therebetween, resulting in problems of non-uniformity in a restoring voltage and troubles in operation.

In the micro-machine switch 110, the contact electrode 122 and the signal line 118 are both composed of gold. Since gold has high electrical conductivity, it would be possible for a switch composed of gold to accomplish small insertion loss and high current-running capacity. However, since gold has a highest adhesion coefficient, gold would generate a high adhesive force.

An operational voltage at which the micro-machine switch 110 operates is dependent on a restoring force generated by the cantilever arm 120 and an electrostatic force generated between the upper electrode 124 and the lower electrode 116.

On the other hand, a characteristic of a contact resistance between the signal line 118 and the upper electrode 122 is dependent predominantly of a contact force. One of factors for determining a contact force is a spring constant of the cantilever 120 after the contact electrode has made contact with the signal line 118.

That is, stiffness of the cantilever arm 120 determines a characteristic of an operational voltage and a characteristic of a contact resistance. Hence, the micro-machine switch 110 has to be designed taking a balance between those characteristics into consideration, resulting in reduction in designability of the micro-machine switch 110.

The conventional micro-switch 110 is singly fabricated on the single substrate 112, and controls on/off of the signal line 118. In other words, the conventional micro-machine switch 110 has only one signal-input section and only one signal-output section. Hence, if a signal was to be output into a predetermined signal line among a plurality of signal lines, it was necessary to fabricate a circuit including a plurality of the micro-machine switches 110 each formed on the substrate 112.

However, such a circuit would increase a size of a system board including the circuit, and further increase a cost of fabricating the system board.

Japanese Unexamined Patent Publication No. 9-147720 has suggested a relay unit including a movable contact block having a movable contact at a center in an upper surface thereof and further having a movable piece deformable in a thickness-wise direction in accordance with an external signal, and a fixed contact block having a fixed contact facing the movable contact, the fixed contact being capable of making contact with and separating away from the movable contact.

Japanese Unexamined Patent Publication No. 9-269336 has suggested a micro G switch including a beam and a movable mass both fabricated by processing a silicon substrate. The movable mass is comprised of a movable contact supported by the beam, and a fixed contact formed on a glass substrate in facing relation to the movable contact. A center of gravity of the movable mass is located on a center line of the beam. The beam, the movable mass, the movable contact and the fixed contact are positioned in a hermetically sealed space formed by the silicon and glass substrates.

The above-mentioned problems remain unsolved even in the above-mentioned Publications.

SUMMARY OF THE INVENTION

In view of the above-mentioned problems in the conventional micro-machine switches, it is an object of the present invention to provide a micro-machine switch which is capable of stably operating and being fabricated in low costs.

In one aspect of the present invention, there is provided a micro-machine switch which causes a contact electrode to make contact with or separate away from a signal line formed on a substrate, to thereby turn on or off the signal line, including (a) first to N-th lower electrodes formed on the substrate, wherein N is an integer equal to or greater than 2, (b) first to N-th upper electrodes supported facing the first to N-th lower electrodes, respectively, and (c) a device for vertically raising and lowering the first to N-th upper electrodes between a first position where the contact electrode makes contact with the signal line when electrostatic force is generated between the first to N-th upper electrodes and the first to N-th lower electrodes, respectively, and a second position where the contact electrode is separated away from the signal line when the electrostatic force is not generated.

It is preferable that the first to N-th lower electrodes are located in symmetry about the signal line.

It is preferable that the first to N-th upper electrodes are located in symmetry about the contact electrode.

There is further provided a micro-machine switch which causes a contact electrode to make contact with or separate away from a signal line formed on a substrate, to thereby turn on or off the signal line, including (a) a first support formed on the substrate, (b) a second support formed on the substrate at a distance away from the first support, (c) a first upper electrode located between the first and second supports, (d) a second upper electrode located between the first upper electrode and the second support, (e) a first resilient member connecting the first support and the first upper electrode to each other such that the first upper electrode is kept floating above the substrate, (f) a second resilient member connecting the second support and the second upper electrode to each other such that the second upper electrode is kept floating above the substrate, (g) a first lower electrode formed on the substrate below the first upper electrode, and (h) a second lower electrode formed on the substrate below the second upper electrode, the contact electrode being supported between the first and second upper electrodes such that the contact electrode is floating above the substrate, the contact electrode being caused to make contact with the signal line when electrostatic force is generated between the first upper electrode and the first lower electrode and further between the second upper electrode and the second lower electrode, the contact electrode being separated away from the signal line due to restoring force generated by the first and second resilient members.

In the above-mentioned micro-machine switch, the first support, the first resilient member, the first upper electrode, the contact electrode, the second upper electrode, the second resilient member and the second support are arranged in this order. The first resilient member, the first upper electrode, the contact electrode, the second upper electrode and the second resilient member are supported floating above the substrate. On the substrate are formed the first and second lower electrodes facing the first and second upper electrodes, respectively.

By applying a voltage between the first and second upper electrodes and the first and second lower electrodes, there is generated an electrostatic force. By increasing this voltage, the generated electrostatic force increases, and hence, the first and second upper electrodes are attracted to the first and second lower electrodes, and resultingly, the contact electrode approaches the signal line.

By further increasing the voltage, a restoring force caused by the first and second resilient members overcomes the electrostatic force, and accordingly, the contact electrode makes contact with the signal line. Thus, the signal line is turned on.

By decreasing the voltage, the contact electrode separates away from the signal line due to the restoring force of the first and second resilient members. As a result, the signal line is turned off.

In the conventional micro-machine switch illustrated in FIGS. 1A and 1B, since the contact electrode moved in a curved line and then made contact with the signal line, there were caused problems of partial contact between the contact electrode and the signal line and slide movement of the contact electrode relative to the signal line.

In contrast, the contact electrode in the present invention makes contact with or separates away from the signal line with being positioned between the first and second upper electrodes. Thus, the contact electrode in the present invention moves in parallel with the signal line when making contact with the signal line, ensuring that the above-mentioned problems of partial contact and slide movement are no longer caused.

The micro-machine switch in accordance with the present invention may have the following structure and function.

The micro-machine switch electrically connects a first signal line formed on a substrate, to a second signal line spaced away from one end of the first signal line, or electrically disconnects the first signal line from the second signal line.

The micro-machine switch includes first and second supports fixed on the substrate and positioned in the vicinity of a space between the first and second signal lines and in symmetry about the signal line, first and second resilient members projecting from the first and second supports, respectively, and mechanically and electrically connected to the first and second supports, respectively, first and second upper electrodes mechanically and electrically connected to the first and second resilient members, respectively, an electrically insulating plate fixed to lower surfaces of the first and second upper electrodes and horizontally spaced away from the substrate, first and second lower electrodes formed on the substrate in alignment with the first and second upper electrodes, respectively, and a contact electrode mounted on a lower surface of the electrically insulating plate.

The first support, the first resilient member and the first upper electrode all located at a side of the signal line are integrally formed, and the second support, the second resilient member and the second upper electrode all located at the other side of the signal line are integrally formed. The contact electrode is equally spaced away from the first and second upper electrodes.

By applying a voltage across the first and second upper electrodes and the first and second lower electrodes, electrostatic forces having the same intensity are generated at the opposite sides of the contact electrode. The electrostatic forces allow the contact electrode to make contact with the signal line in parallel. When the voltage is stopped from being applied across the first and second upper electrodes and the first and second lower electrodes, the contact electrode separates away from the signal line in parallel.

Thus, it is possible to solve the above-mentioned problems of partial contact and slide movement, and ensure a preferred characteristic in operation.

By composing the contact electrode of ruthenium, for instance, it would be possible to reduce an adhesive force of the contact electrode down to such a degree that the adhesive force does not harmfully influence an operational characteristic of the micro-machine switch.

In the micro-machine switch in accordance with the present invention, after the contact electrode has made contact with the signal line, the electrical insulating member surrounds the contact electrode. As a result, a contact force which determines a contact resistance characteristic can be ensured due to stiffness of the electrical insulating plate, and has nothing to do with stiffness of the first and second resilient members which determine an operational voltage characteristic.

Hence, the designability of the micro-machine switch can be enhanced.

A plurality of the above-mentioned micro-machine switches may be formed on a single substrate. Specifically, a plurality of signal input sections and a plurality of signal output sections are formed on a single substrate, and the micro-machine switches are arranged across the signal input sections and the signal output sections. This arrangement makes it possible to output a signal into a predetermined signal output section. This ensures reduction in a size of a system board including the micro-machine switches.

It is preferable that the micro-machine switch further includes an electrical insulator extending between the first and second resilient members in parallel with the substrate, and having a first surface facing the substrate and a second surface not facing the substrate, the contact electrode being mounted on the first surface of the electrical insulator, the first and second upper electrodes being mounted on the second surface of the electrical insulator.

For instance, the electrical insulator may be in the form of a plate.

It is preferable that the micro-machine switch further includes a first pad formed on the substrate and electrically connected to the first upper electrode through a wire, and a second pad formed on the substrate and electrically connected to the second upper electrode through a wire.

It is preferable that the micro-machine switch further includes a third pad formed on the substrate and electrically connected to the first lower electrode through a wire, and a fourth pad formed on the substrate and electrically connected to the second lower electrode through a wire.

It is preferable that the substrate has a grounded area surrounding the signal line, the grounded area being electrically connected to the first and second lower electrodes.

It is preferable that the grounded area surrounds the signal line at a constant distance therebetween.

For instance, the substrate may be composed of glass or silicon.

It is preferable that at least a surface of the contact electrode is composed of ruthenium (Ru), rhodium (Rh) or gold cobalt, in which case, it is preferable that the contact electrode is composed of gold except the surface.

It is preferable that at least a surface of the signal line is composed of ruthenium (Ru), rhodium (Rh) or gold cobalt, in which case, it is preferable that the signal line is composed of gold except the surface.

The micro-machine switch may further include a reinforcing plate mounted on the second surface of the electrical insulator between the first and second upper electrodes.

It is preferable that the reinforcing plate has a larger area than an area of the contact electrode, and has a greater thickness than thicknesses of the contact electrode and the electrical insulator.

It is preferable that a first gap between the first upper electrode and the first lower electrode is equal to a second gap between the second upper electrode and the second lower electrode, and the first and second gaps are greater than a third gap between the contact electrode and the signal line.

It is preferable that the first and second upper electrodes are electrically connected to each other through a wire, and the first and second lower electrodes are electrically connected to each other through a wire.

In another aspect of the present invention, there is provided a micro-machine switch unit including (a) a substrate, (b) first to N-th micro-machine switches wherein N is an integer equal to or greater than 2, and (c) a common signal line and first to N-th signal lines all formed on the substrate, a K-th micro-machine switch electrically connecting the common signal line to a K-th signal line and electrically disconnecting the common signal line from a K-th signal line wherein K is an integer in the range of 1 to N both inclusive. Each of the first to N-th micro-machine switches is comprised of the above-mentioned micro-machine switch.

In still another aspect of the present invention, there is provided a method of fabricating a micro-machine switch including a first substrate, first and second supports standing on the first substrate, first and second upper electrodes located between the first and second supports, and first and second resilient members connecting the first and second supports to the first and second upper electrodes such that the first and second upper electrodes are kept floating above the first substrate, the method including the steps of (a) etching the first substrate in a selected area, (b) forming a mask on the first substrate, (c) diffusing an impurity into the first substrate in an area not covered with the mask, to thereby make a pattern of the first and second supports, the first and second upper electrodes, and the first and second resilient members, (d) forming an electrical insulator on the first substrate such that the first and second upper electrodes are located on the electrical insulator, (e) forming a contact electrode between the first and second upper electrodes, (f) fixating the first substrate on a second substrate such that the first and second supports stand on the second substrate, a signal line being formed on the second substrate in alignment with the contact electrode, first and second lower electrodes being formed on the second substrate in alignment with the first and second upper electrodes, respectively, and (g) melting the first substrate except the area into which the impurity was diffused.

It is preferable that a pattern of a reinforcing plate is also made in the step (c), the reinforcing plate being mounted on the electrical conductor between the first and second upper electrodes in a final product.

It is preferable that the first substrate is fixated to the second substrate in the step (f) by electrostatic bonding.

It is preferable that the first substrate is composed of silicon and the second substrate is composed of ceramics or GaAs, and the first substrate is fixated to the second substrate through an adhesive.

The advantages obtained by the aforementioned present invention will be described hereinbelow.

In accordance with the present invention, a contact electrode moves in parallel with a signal line, and makes contact with the signal line. Thus, the problems of partial contact between a contact electrode and a signal line and slide movement between a contact electrode and a signal line, which remain unsolved in the conventional micro-machine switch, can be solved. Accordingly, the micro-machine switch can stable operate.

In other words, in the micro-machine switch in accordance with the present invention, electrostatic forces necessary for turning a signal line on are generated in symmetry about a contact electrode, and restoring forces necessary for turning a signal line off are generated in symmetry about a contact electrode. This structure enables a contact electrode to make contact with a signal line almost in parallel. Hence, it would be possible to prevent partial contact and slide movement of a contact electrode when the contact electrode makes contact with or separates away from a signal line.

In addition, by composing a contact electrode of rhodium, ruthenium or gold cobalt, it would be possible to minimize adhesion in a contact area of a contact electrode at which the contact electrode makes contact with a signal line, ensuring both reduction in non-uniformity in a voltage to be applied across the upper and lower electrodes, and prevention of troubles in operation.

An operational voltage can be ensured by stiffness of the first and second resilient members, and a contact force of a contact area where a contact electrode makes contact with a signal line can be ensured by stiffness of the electrical insulator. As a result, the micro-machine switch could have enhanced designability.

Furthermore, a plurality of output signal lines, a common signal line electrically connected to each of the output signal lines, and a plurality of the micromachine switches can be formed on a single substrate. This ensures that an apparatus which can turn on or off a plurality of signal lines can be fabricated in a small size and in low fabrication costs.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Preferred embodiments in accordance with the present invention will be explained hereinbelow with reference to drawings.

Figure 1A:
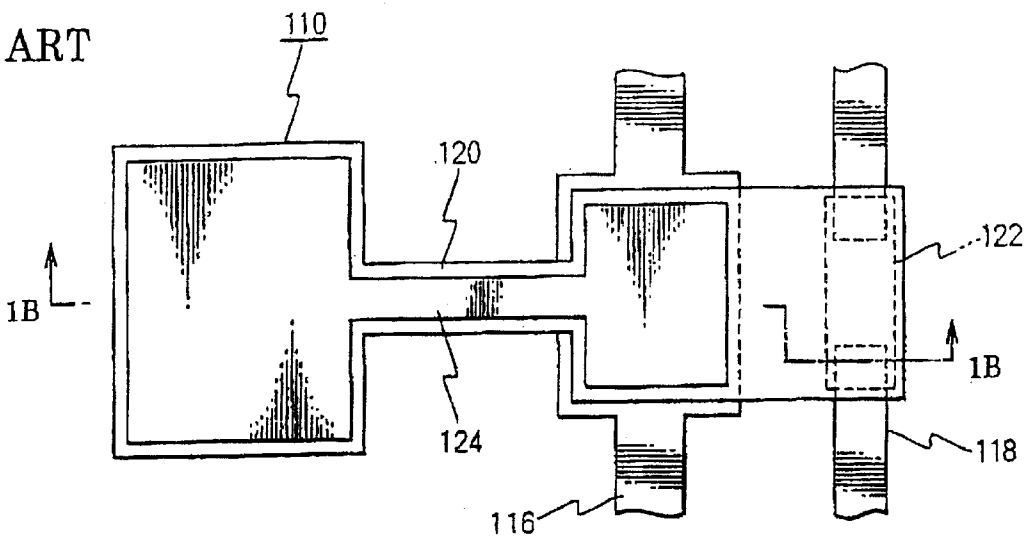
FIG.1A PRIOR ART
FIG. 1A is a plan view of a conventional micro-machine switch.
Figure 1B:
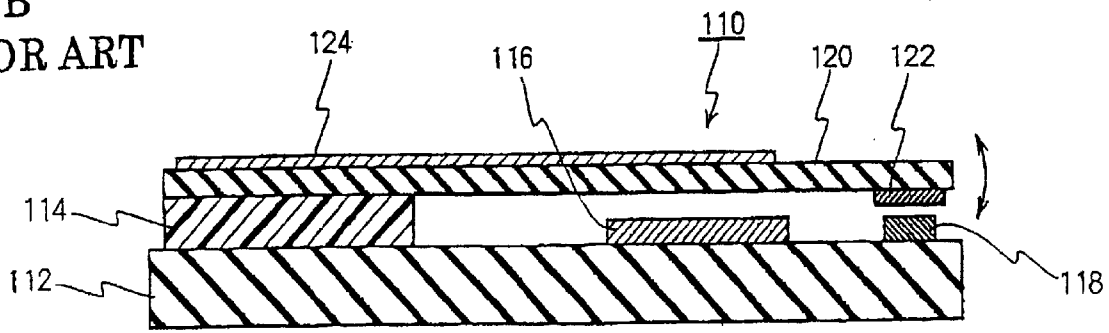
FIG.1B PRIOR ART
FIG. 1B is a cross-sectional view taken along the line 1B—1B in FIG. 1A.
Figure 2:
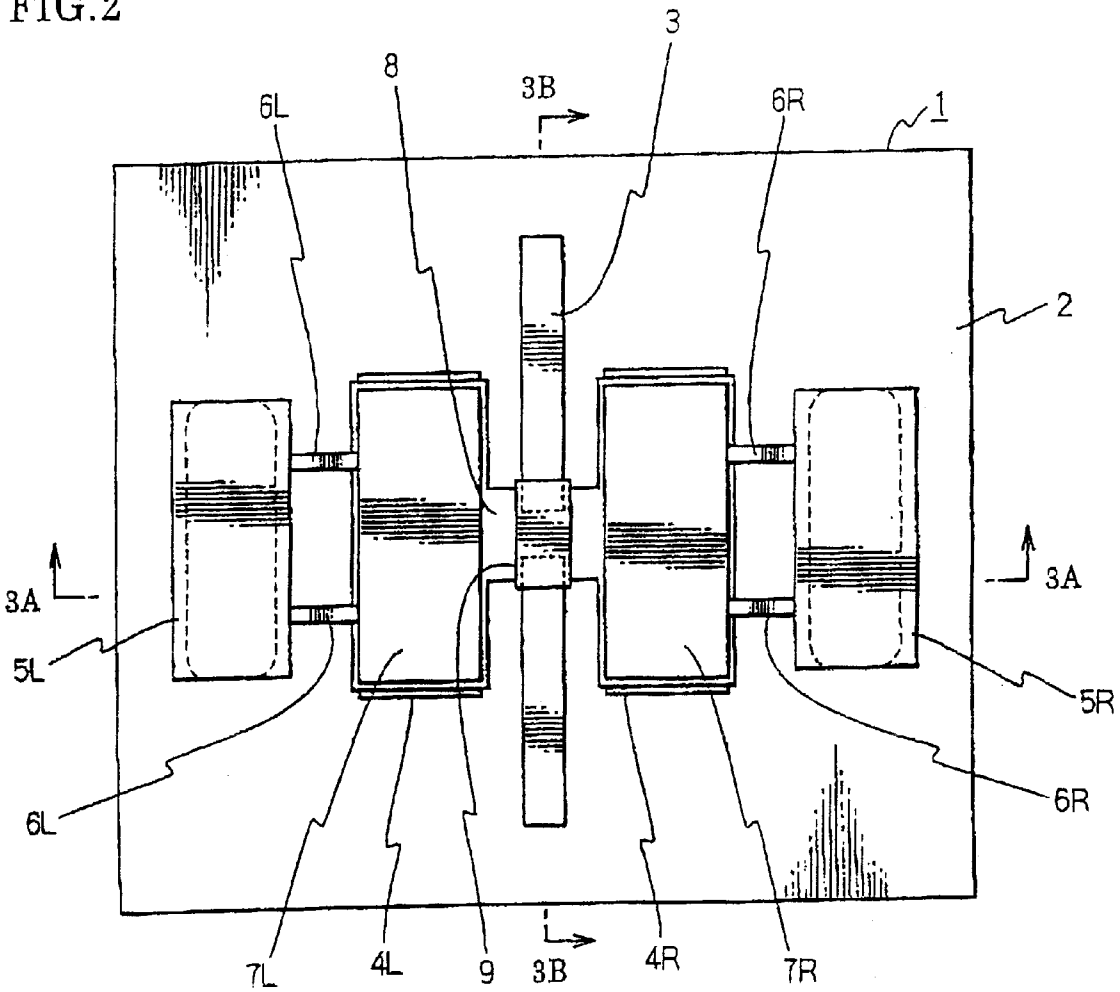
FIG. 2 is a plan view of a micro-machine switch in accordance with the first embodiment of the present invention.
Figure 3A:
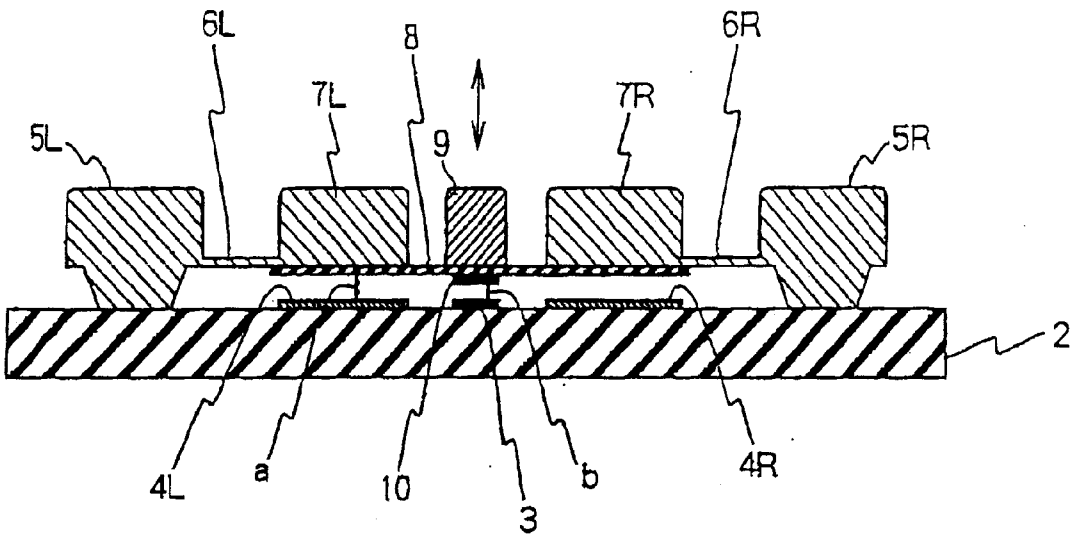
FIG. 3A is a cross-sectional view taken along the line 3A—3A in FIG. 2.
Figure 3B:
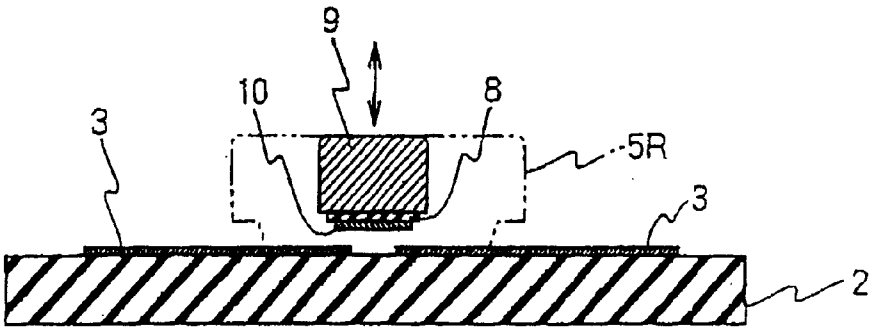
FIG. 3B is a cross-sectional view taken along the line 3B—3B in FIG. 2.
Figure 4A:
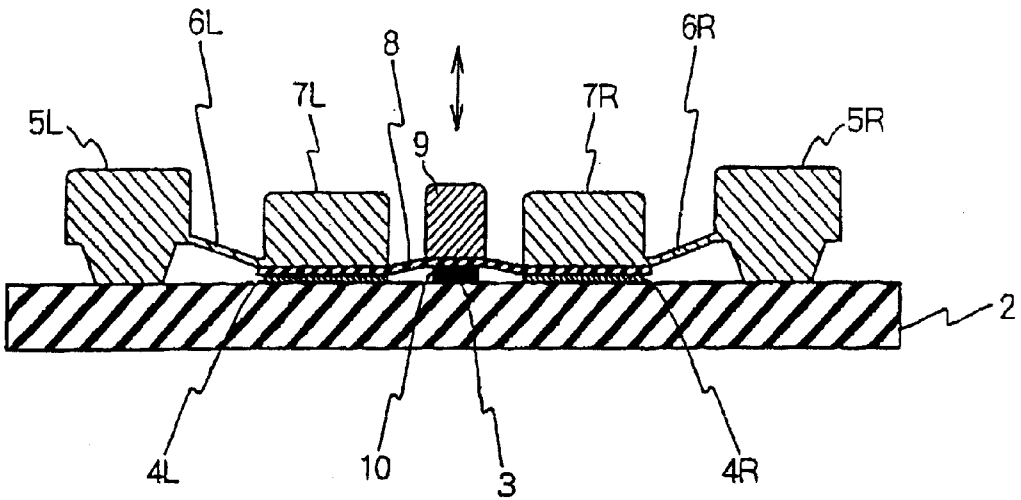
FIG. 4A is a cross-sectional view of the micro-machine switch in accordance with the first embodiment, taken along the line 3A—3A in FIG. 2, in operation when a voltage is applied across upper and lower electrodes.
Figure 4B:
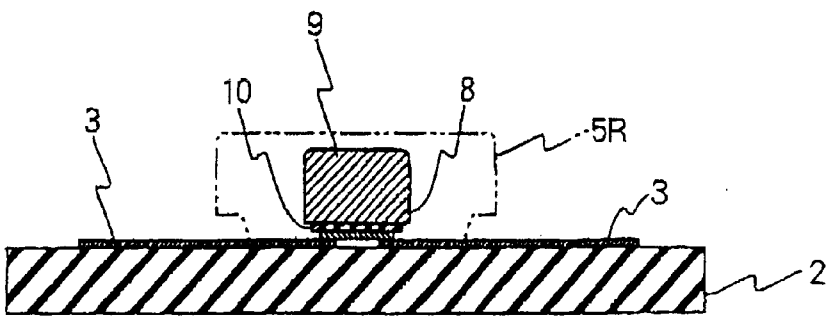
FIG. 4B is a cross-sectional view of the micro-machine switch in accordance with the first embodiment, taken along the line 3B—3B in FIG. 2, in operation when a voltage is applied across upper and lower electrodes.

FIGS. 2, 3A, 3B, 4A and 4B illustrate a micro-machine switch in accordance with the first embodiment of the present invention. FIG. 2 is a plan view of the micro-machine switch, FIG. 3A is a cross-sectional view taken along the line 3A—3A in FIG. 2, and FIG. 3B is a cross-sectional view taken along the line 3B—3B in FIG. 2. FIGS. 4A and 4B illustrate the micro-machine switch in operation.

With reference to FIGS. 2, 3A and 3B, the micro-machine switch 1 causes a contact electrode 10 to make contact with or separate away from a signal line 3 formed on a substrate 2, to thereby turn on or off the signal line 3.

The micro-machine switch 1 includes a first support 5L formed on the substrate 2, a second support 5R formed on the substrate 2 at a distance away from the first support 5L, a first upper electrode 7L located between the first and second supports 5A and 5B, a second upper electrode 7R located between the fist upper electrode 7L and the second support 5R, a first resilient member 6L connecting the first support 5L and the first upper electrode 7L to each other such that the first upper electrode 7L is kept floating above the substrate 2, a second resilient member 6R connecting the second support 5R and the second upper electrode 7R to each other such that the second upper electrode 7R is kept floating above the substrate 2, a first lower electrode 4L formed on the substrate 2 below the first upper electrode 7L, a second lower electrode 4R formed on the substrate 2 below the second upper electrode 7R, an electrically insulating plate 8 extending between the first and second resilient members 6L and 6R in parallel with the substrate 2, and having a first surface facing the substrate 2 and a second surface on which the first and second upper electrodes 6L and 6R are mounted, and a reinforcing plate 9 mounted on the second surface of the electrically insulating plate 8 just above the signal line 3 formed on the substrate 2.

The contact electrode 10 is mounted on the first surface of the electrically insulating plate 9 just above the signal line 3.

The contact electrode 10 is caused to make contact with the signal line 3 when electrostatic force is generated between the first upper electrode 7L and the first lower electrode 4L and further between the second upper electrode 7R and the second lower electrode 4R.

The contact electrode 10 is separated away from the signal line 3 due to restoring force generated by the first and second resilient members 6L and 6R, when a voltage is stopped being applied across the first and second upper electrodes 7L and 7R and the first and second lower electrodes 4L and 4R.

The substrate 2 is composed of glass. The signal line 3 and the first and second lower electrodes 4L and 4R are all composed of an electrical conductor. The first and second supports 5L and 5R and the first and second upper electrodes 7L and 7R are all composed of silicon.

The electrically insulating plate 8 has a multi-layered structure comprised of a silicon dioxide film and a silicon nitride film.

As illustrated in FIG. 2, the electrically insulating plate 8 is formed larger than the first and second upper electrodes 7L and 7R by 10 to 20 micrometers. This is to prevent outer edges of the first and second upper electrodes 7L and 7R and the first and second lower electrodes 4L and 4R from being damaged by electric discharge when a voltage is applied across the first and second upper electrodes 7L and 7R and the first and second lower electrodes 4L and 4R.

The reinforcing plate 9 is composed of silicon. The reinforcing plate 9 is designed to be larger than the contact electrode 10 in an area, and have a greater thickness than thicknesses of the contact electrode 10 and the electrically insulating plate 8. The reinforcing plate 9 reduces deformation and curvature in both the electrically insulating plate 8 and the contact electrode 10.

FIGS. 4A and 4B illustrate the micro-machine switch 1 in operation. FIG. 4A is a cross-sectional view taken along the line 3A—3A in FIG. 2, and FIG. 4B is a cross-sectional view taken along the line 3B—3B in FIG. 2.

Specifically, FIGS. 4A and 4B illustrate the micro-machine switch 1 in which a voltage is applied across the first and second upper electrodes 7L and 7R and the first and second lower electrodes 4L and 4R, and hence, the contact electrode 10 makes contact with the signal line 3. In contrast, FIGS. 3A and 3B illustrate the micro-machine switch 1 in which a voltage is stopped being applied across the first and second upper electrodes 7L and 7R and the first and second lower electrodes 4L and 4R, and hence, the contact electrode 10 is separated away from the signal line 3.

The micro-machine switch 1 operates when a predetermined voltage is applied across the first and second upper electrodes 7L and 7R and the first and second lower electrodes 4L and 4R.

On application of the voltage across the first and second upper electrodes 7L and 7R and the first and second lower electrodes 4L and 4R, an electrostatic force is generated between the first upper electrode 7L and the first lower electrode 4L and further between the second upper electrode 7R and the second lower electrode 4R.

When the electrostatic force becomes greater than resilient forces of the first and second resilient members 6L and 6R, the first and second upper electrodes 7L and 7R are attracted to the first and second lower electrodes 4L and 4R, respectively. As a result, the first and second resilient members 6L and 6R are deformed towards the substrate 2, and at the same time, the electrically insulating plate 8 and the contact electrode 10 are displaced towards the substrate 2 together with the first and second upper electrodes 7L and 7R Since an electrostatic force generated between the first upper electrode 7L and the first lower electrode 4L is equal in intensity to an electrostatic force generated between the second upper electrode 7R and the second lower electrode 4R, the contact electrode 10 moves towards the signal line 3 in parallel.

As illustrated in FIG. 3A, a spatial gap "a" between the first upper electrode 7L and the first lower electrode 4L is greater than a spatial gap "b" between the contact electrode 10 and the signal line 3. Hence, the contact electrode 10 makes first contact with the signal line 3.

Thereafter, the first and second upper electrodes 7L and 7R are attracted to the first and second lower electrodes 4L and 4R, as if the contact electrode 10 and connection at which the first and second resilient members 6L and 6R are connected to the first and second supports 5L and 5R act as fixed ends.

Since the electrically insulating plate 8 is deformed as a flexible spring towards the substrate 2, the electrically insulating plate 8 generates a restoring force, apart from the restoring forces generated by the first and second resilient members 6L and 6R, in a direction far away from the substrate 2, that is, a direction opposite to a direction in which the electrostatic force is directed.

When the electrostatic force which is in proportion to a square of an applied voltage is greater than the restoring forces, the first and second upper electrodes 7L and 7R are attracted to the first and second lower electrodes 4L and 4R, and then, make contact with the first and second lower electrodes 4L and 4R, respectively.

In the above-mentioned sequence of actions of the micro-machine switch 1, the electrically insulating plate 8 acting as a flexible spring provides a contact force which maintains an appropriate contact resistance between the contact electrode 10 and the signal line 3.

If a voltage applied across the first and second upper electrodes 7L and 7R and the first and second lower electrodes 4L and 4R is gradually lowered, the first and second upper electrodes 7L and 7R are separated away from the first and second lower electrodes 4L and 4R, and then, the contact electrode 10 is separated away from the signal line 3. As a result, the signal line 3 is turned off.

In this operation, there is possibility that the contact electrode 10 is adhered to the signal line 3. However, since the micro-machine switch 1 is designed to have such a structure that the contact electrode 10 moves relative to the signal line 3 in parallel, it is possible to avoid slide movement of the contact electrode 10 relative to the signal line 3, which facilitates adhesion between the contact electrode 10 and the signal line 3.

In particular, by composing the contact electrode 10 of rhodium, ruthenium or gold cobalt all of which have a low adhesion coefficient, the adhesion can be minimized.

Figure 5:
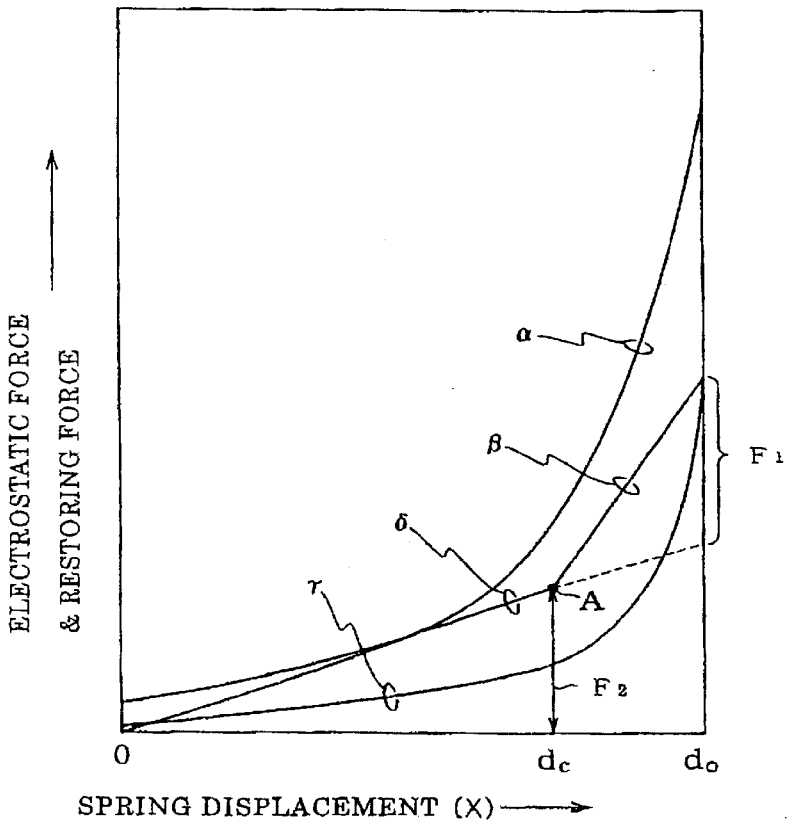
FIG. 5 is a graph showing an operation characteristic in the micro-machine switch in accordance with the first embodiment.

FIG. 5 is a graph showing a characteristic of an operation of the micro-machine switch 1. Hereinbelow are explained factors which determine a characteristic of an operation of the micro-machine switch 1.

FIG. 5 shows the electrostatic force generated between the first and second upper electrodes 7L and 7R and the first and second lower electrodes 4L and 4R, the first restoring force generated by the first and second resilient members 6L and 6R, and the second restoring force generated by the electrically insulating plate 8 acting as a spring.

Though the electrostatic force is generated in a direction towards the substrate 2, and the fist and second restoring forces are generated in a direction far away from the substrate 2, those forces are illustrated in FIG. 5 as having the same direction.

In FIG. 5, an axis of abscissa indicates displacement of the first and second resilient members 6L and 6R and the electrically insulating plate 8, that is, a spatial gap between the first and second upper electrodes 7L and 7R and the first and second lower electrodes 4L and 4R, and an axis of ordinate indicates an absolute value of the electrostatic force and the first and second storing forces.

As mentioned earlier, after the contact electrode 10 has made contact with the signal line 3, the first and second upper electrodes 7L and 7R make contact with the first and second lower electrodes 4L and 4R with the electrically insulating plate 8 being sandwiched therebetween. Hence, a inflection point A in a spring stiffness indicates a status where the contact electrode 10 has made contact with the signal line 3.

That is, a spring stiffness in the range of 0 to dc in the spring displacement X ($0 \leqq X \leqq dc$) indicates a sum $\delta$ of stiffness of the first and second resilient members 6L and 6R, and a spring stiffness in the range of dc to do in the spring displacement X ($dc \leqq X \leqq do$) indicates a sum $\beta$ of stiffness of the first and second resilient members 6L and 6R and the electrically insulating plate 8. A maximum spring displacement Xmax indicates an initial spatial gap between the first and second upper electrodes 7L and 7R and the first and second lower electrodes 4L and 4R (Xmax=do).

On application of a voltage across the first and second upper electrodes 7L and 7R and the first and second lower electrodes 4L and 4R to thereby generate an electrostatic force therebetween, the electrostatic force becomes greater than the restoring force at a certain voltage in the range of 0 to do in the spring displacement X($0 \leqq X \leqq do$), as indicated with a curve $\alpha$.

A voltage causing this is an operational voltage at which the micro-machine switch 1 operates. That is, when the operational voltage is applied across the first and second upper electrodes 7L and 7R and the first and second lower electrodes 4L and 4R, the first and second upper electrodes 7L and 7R make contact with the first and second lower electrodes 4L and 4R, and accordingly, the contact electrode 10 mounted on the first surface of the electrically insulating plate 8 makes contact with the signal line 3 with the result that the signal line 3 is turned on.

In contrast, when a voltage to be applied across the first and second upper electrodes 7L and 7R and the first and second lower electrodes 4L and 4R is gradually decreased, the restoring force becomes greater than the electrostatic force as indicated with a curve $\gamma$.

A voltage causing this is a restoring voltage at which the first and second upper electrodes 7L and 7R are separated away from the first and second lower electrodes 4L and 4R The contact electrode 10 is also separated away from the signal line 3 with the result that the signal line 3 is turned off.

There is known a phenomenon where there is not provided sufficient contact force for maintaining a contact resistance appropriate, because the first and second upper electrodes 7L and 7R do not make contact with the first and second lower electrodes 4L and 4R, even if the contact electrode 10 has made contact with the signal line 3.

In the first embodiment, in order to prevent such a phenomenon, a minimum difference between the electrostatic force and the restoring force in the range of 0 to dc in the spring displacement X($0 \leqq X \leqq dc$) is designed smaller than a minimum difference between the electrostatic force and the restoring force in the range of dc to do in the spring displacement X($dc \leqq X \leqq do$). Hence, if the electrostatic force is greater than the restoring force in the range of 0 to dc in the spring displacement X($0 \leqq X \leqq dc$), the contact electrode 10 makes contact with the signal line 3, and additionally, the first and second upper electrodes 7L and 7R are sufficiently attracted to the first and second lower electrodes 4L and 4R As a result, there is obtained a desired contact force.

In contrast, when a voltage to by applied across the first and second upper electrodes 7L and 7R and the first and second lower electrodes 4L and 4R is gradually decreased, the restoring force becomes greater than the electrostatic force as indicated with a curve $\gamma$.

In the first embodiment, in order to prevent such a phenomenon, the electrostatic force is determined to be smaller than the restoring force when the spring displacement X is equal to do (X=do). Hence, since the electrostatic force is smaller than the restoring force in almost entire range of 0 to do in the spring displacement X($0 \leqq X \leqq do$), the contact electrode 10 can be separated away from the signal line 3, if the first and second upper electrodes 7L and 7R are separated away from the first and second lower electrodes 4L and 4R.

As mentioned above, an electrostatic force and a restoring force are factors which determine a characteristic of an operation of the micro-machine switch 1. The first embodiment can make it possible to determine those factors in a broad range, ensuring enhancement in designability of the micro-machine switch.

FIGS. 6A to 6F are cross-sectional views of the micro-machine switch 1, illustrating respective steps of a method of fabricating the same.

Figure 6A:
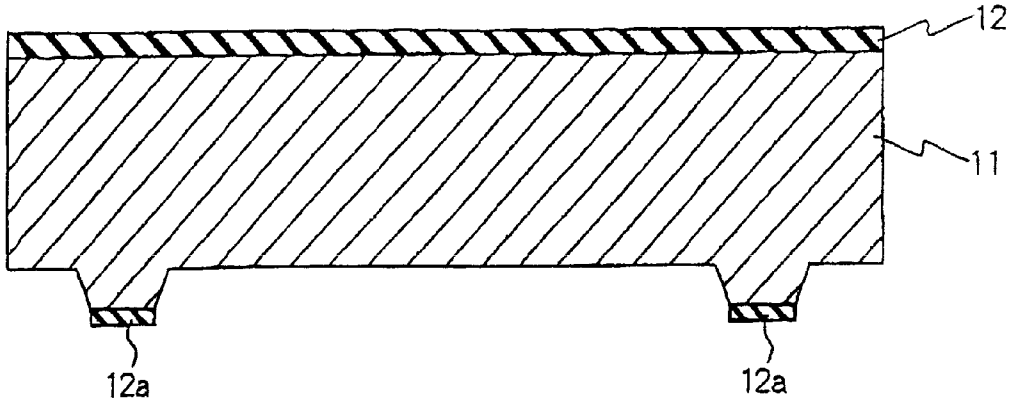
FIGS. 6A to 6F are cross-sectional views of the micro-machine switch in accordance with the first embodiment, illustrating respective steps of a method of fabricating the same.

First, a pattern composed of a silicon dioxide film 12*a* is formed on a silicon substrate 11 at upper and lower surfaces thereof. Then, as illustrated in FIG. 6A, the silicon substrate 11 is etched by about 9 micrometers with the silicon dioxide film pattern 12*a* being used as a mask through the use of an etchant such as TMAH.

Figure 6B:
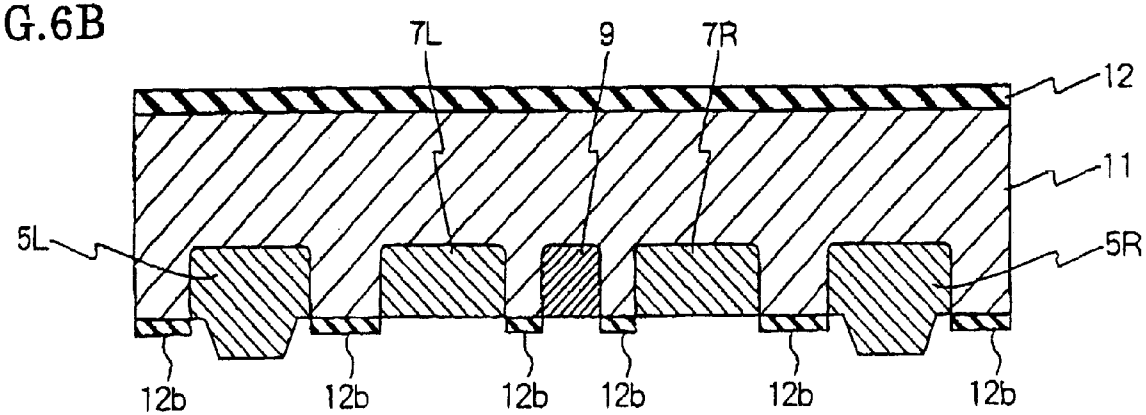

After the silicon dioxide film 12*a* has been removed, there is formed a pattern composed of a silicon dioxide film 12*b*, as illustrated in FIG. 6B. Then, boron is diffused into the silicon substrate 11 with the silicon dioxide film pattern 12*b* being used as a mask. Thus, boron is diffused into the silicon substrate 11 in an area not covered with the silicon dioxide film pattern 12*b*, thereby forming a pattern of the first and second supports 5L and 5R, the first and second upper electrodes 7L and 7R, and the reinforcing plate 9.

In order to diffuse boron deeply into the silicon substrate 11, thermal diffusion of boron is carried out, for instance, at 1150 degrees centigrade for 10 hours. As a result, boron is diffused into the silicon substrate 11 within a depth of about 10 micrometers.

Figure 6C:
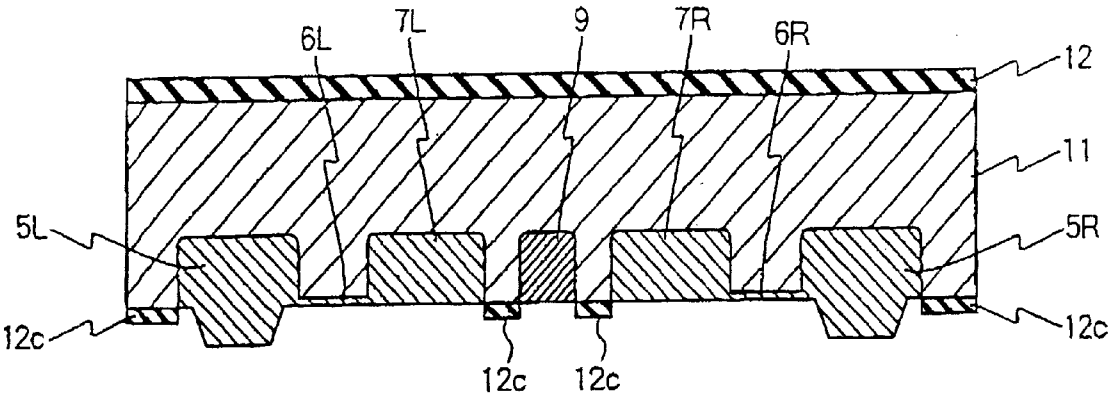

After the silicon dioxide film pattern 12*b* has been partially removed, boron is diffused into the silicon substrate 11 with the remaining silicon dioxide film pattern 12*b* being used as a mask. As illustrated in FIG. 6C, boron is diffused into the silicon substrate 11 in an area not covered with the silicon dioxide film pattern 12*b*, thereby forming a pattern of the first and second resilient members 6L and 6R.

Then, in order to diffuse boron shallowly into the silicon substrate 11, thermal diffusion of boron is carried out, for instance, at 1150 degrees centigrade for 2 hours. As a result, boron is diffused into the silicon substrate 11 within a depth of about 2 micrometers.

Figure 6D:
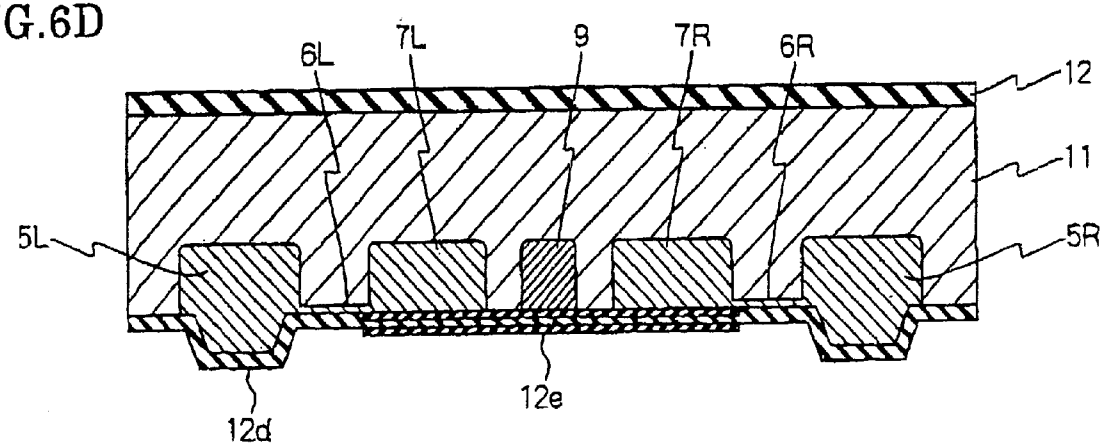

Then, as illustrated in FIG. 6D, a pattern of the electrically insulating plate 8 is formed on the silicon substrate 11. The pattern of the electrically insulating plate 8 is comprised of upper and lower nitride layers 12*e* each having a thickness of 0.03 micrometers, and a silicon dioxide layer 12*d* having a thickness of 1.3 micrometer and sandwiched between the upper and lower nitride layers 12*e*.

Figure 6E:
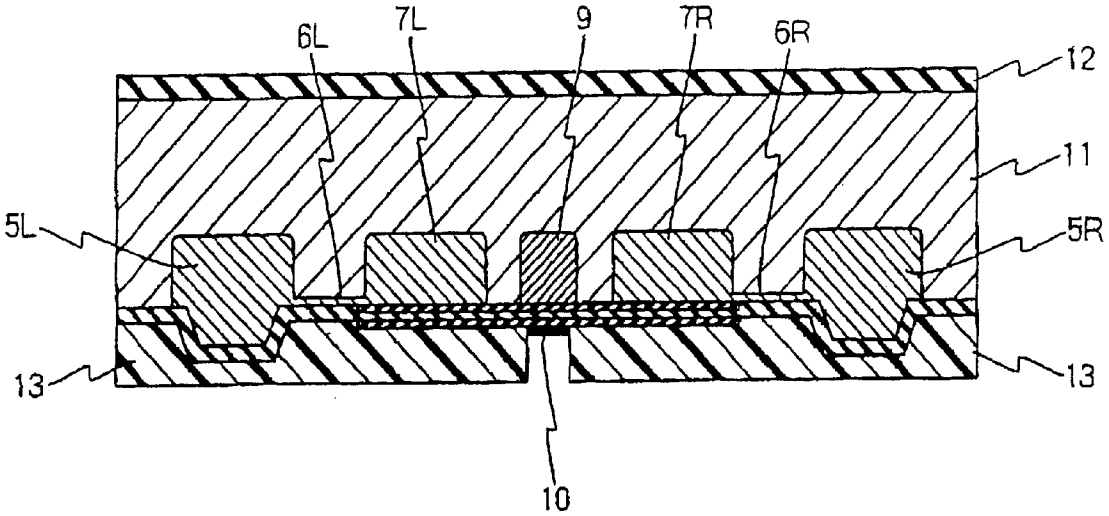

Then, as illustrated in FIG. 6E, a resist 13 is coated on the silicon substrate 11 in an area other than an area in which the contact electrode 10 is to be formed. Then, the contact electrode 10 is formed by plating or sputtering.

After removal of the resist 13, the silicon substrate 11 is bonded onto a glass substrate 2 on which a pattern composed of gold has been already formed. The silicon substrate 11 may be bonded to the glass substrate 2 by electrostatic bonding.

Then, the silicon substrate 11 and the glass substrate 2 are dipped into an etching solution such as ethylenediaminepyrocatechol in which a boron concentration can be determined in a broad range. As a result, as illustrated in FIG. 6F, the silicon substrate 11 is molten other than an area into which boron has been diffused.

Figure 6F:
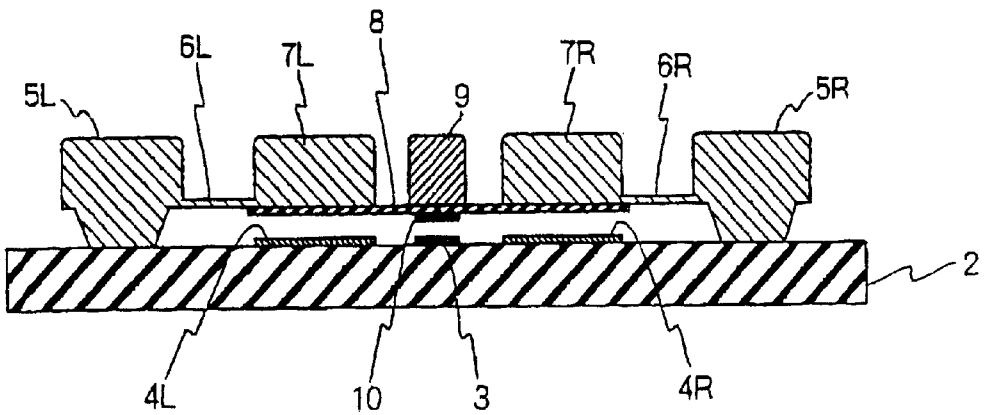

Thus, there is completed the micro-machine switch 1 as illustrated in FIG. 6F.

In the above-mentioned method, the micro-machine switch 1 is fabricated on the glass substrate 2. If the micro-machine switch 1 is to be fabricated on a substrate composed of ceramics or gallium arsenide (GaAs), the silicon substrate 11 may be bonded to the substrate through an adhesive. As an alternative, the silicon substrate 11 may be bonded to the substrate by electrostatic bonding, if a glass layer is formed on the substrate by about 2 to 5 micrometers by sputtering.

In the above-mentioned method, the parts constituting the micro-machine switch 1 are fabricated by etching the silicon substrate 11. Since single crystal substrate can be used in a method where major parts are fabricated by etching a substrate, a resultant could have high reliability in mechanical characteristic.

Apart from the above-mentioned method, the micro-machine switch 1 may be fabricated by forming thin films on the substrate 2 on which the signal line 3 has been already formed, and selectively etching the thin films, as suggested in the above-mentioned Japanese Unexamined Patent Publication No. 9-17300.

An example of dimensions of the parts constituting the micro-machine switch 1 is described hereinbelow.

The first and second resilient members 6L and 6R have a length in the range of 80 to 90 micrometers, a width in the range of 20 to 30 micrometers, and a thickness in the range of 1 to 5 micrometers.

The electrically insulating plate 8 has a length in the range of 40 to 100 micrometers, a width in the range of 100 to 650 micrometers, and a thickness in the range of 1 to 3 micrometers.

The first and second upper electrodes 7L and 7R and the first and second lower electrodes 4L and 4R overlap each other in an area having a length in the range of 300 to 600 micrometers and a width in the range of 800 to 900 micrometers, and are vertically spaced away from each other by a gap in the range of 5 to 10 micrometers.

The contact electrode 10 is vertically spaced away from the signal line 3 by a gap in the range of 3 to 10 micrometers.

The signal line 3 has a width in the range of 10 to 200 micrometers, and a thickness in the range of 1 to 5 micrometers.

The micro-machine switch 1 having the above-mentioned dimensions was measured with respect to electric characteristics. The measurement results are as follows.

It was confirmed that the contact electrode 10 made contact with the signal line 3 at a voltage in the range of about 20 to about 40 volts, and the contact electrode 10 was separated away from the signal line 3 at a voltage in the range of about 15 to about 30 volts.

It was also confirmed that the contact electrode 10 made contact with the signal line 3 within 200 microseconds after application of a voltage, regardless that the measurement was carried out in an atmosphere, and the contact electrode 10 was separated away from the signal line 3 within 100 microseconds after stopping application of a voltage.

In addition, it was also confirmed that the first and second resilient members 7L and 7R and the electrically insulating plate 8 were not damaged even after operation of the micro-machine switch 1 hundred million times.

Figure 7:
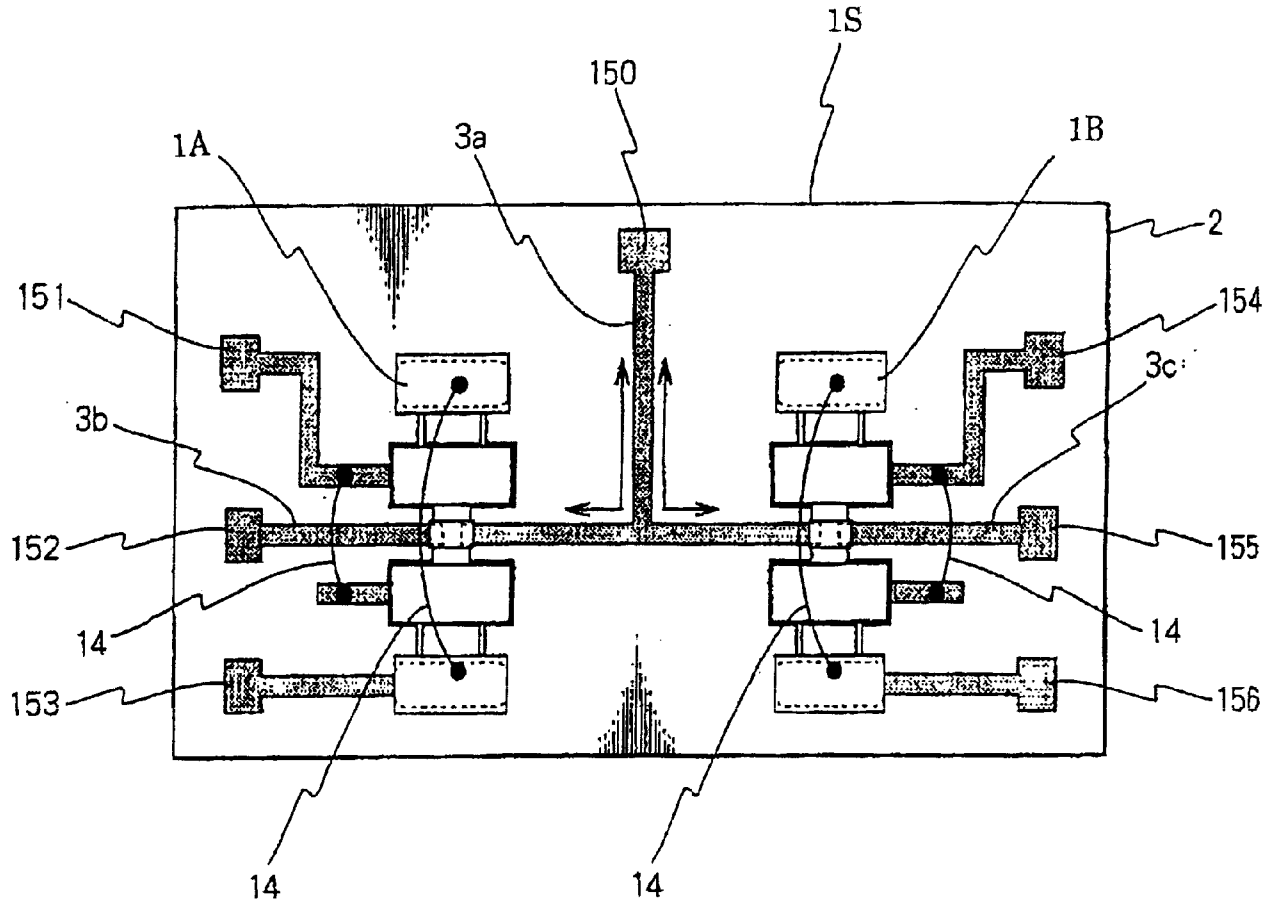
FIG. 7 is a plan view of a micro-machine switch in accordance with the second embodiment of the present invention.

FIG. 7 is a plan view of a micro-machine switch unit 1S in accordance with the second embodiment of the present invention.

The micro-machine switch unit 1S is designed to include a first micro-machine switch 1A and a second micro-machine switch unit 1B. Both the first and second micro-machine switches 1A and 1B are designed to have the same structure as the structure of the micro-machine switch 1 illustrated in FIGS. 2, 3A and 3B.

The first and second micro-machine switches 1A and 1B are fabricated on the silicon substrate 2. On the silicon substrate 2 are also formed a common signal line 3*a*, a first signal line 3*b*, and a second signal line 3*c*. The micro-machine switch unit 1S electrically connects the first signal line 3*b* to the common signal line 3*a* and electrically disconnects the first signal line 3*b* from the common signal line 3*a*, and further electrically connects the second signal line 3*c* to the common signal line 3*a* and electrically disconnects the second signal line 3*c* from the common signal line 3*a*.

The common signal line 3*a* and the first and second signal lines 3*b* and 3*c* are composed of electrically conductive material. The first signal line 3*b* is electrically connected to or disconnected from the common signal line 3*a* through the first micro-machine switch 1A, and the second signal line 3*c* is electrically connected to or disconnected from the common signal line 3*a* through the second micro-machine switch 1B.

In both of the first and second micro-machine switches 1A and 1B, the first and second upper electrodes 7L and 7R are electrically connected to each other through a wire 14, and the first and second lower electrodes 4L and 4R are also electrically connected to each other through a wire 14, in order to reduce the number of an area at which a voltage is to be applied for driving a micro-machine switch, and enable the micro-machine switches 1A and 1B to electrically connect to an external package (not illustrated).

First to seventh pads 150 to 156 are formed on the silicon substrate 2 in order to electrically connect the first and second micro-machine switches 1A and 1B to an external package.

The first pad 150 is electrically connected to the common signal line 3*a*, the second pad 151 is electrically connected to the first and second lower electrodes 4L and 4R in the first micro-machine switch 1A, the third pad 152 is electrically connected to the first signal line 3*b*, the fourth pad 153 is electrically connected to the first and second upper electrodes 7L and 7R in the first micro-machine switch 1A, the fifth pad 154 is electrically connected to the first and second lower electrodes 4L and 4R in the second micro-machine switch 1B, the sixth pad 155 is electrically connected to the second signal line 3*c*, and the seventh pad 156 is electrically connected to the first and second upper electrodes 7L and 7R in the second micro-machine switch 1B.

The fourth pad 153 is electrically connected to the second upper electrode 7R through the second support 5R and the second resilient member 6R in the first micro-machine switch 1A. The seventh pad 156 is electrically connected to the second upper electrode 7R through the second support 5R and the second resilient member 6R in the second micro-machine switch 1B.

The first to seventh pads 150 to 156 are electrically connected to an external package through bonding wires.

Though the common signal line 3*a* and the first and second signal lines 3*b* and 3*c* are arranged in T-shape, they may be arranged in another pattern in dependence on a size of the micro-machine switch unit and a requirement of a transmission line characteristic.

The micro-machine switch unit 1S can be fabricated in the method having been explained with reference to FIGS. 6A to 6F merely by changing a pattern of the glass substrate 2 and the silicon substrate 11 without any change in the rest of the steps. Hence, it would be possible to control turning on or off in a plurality of signal lines by arranging a plurality of the micro-machine switch unit 1S.

In addition, a final product can be fabricated smaller by virtue of the advantage that a plurality of the micro-machine switches can be integrally fabricated.

Figure 8:
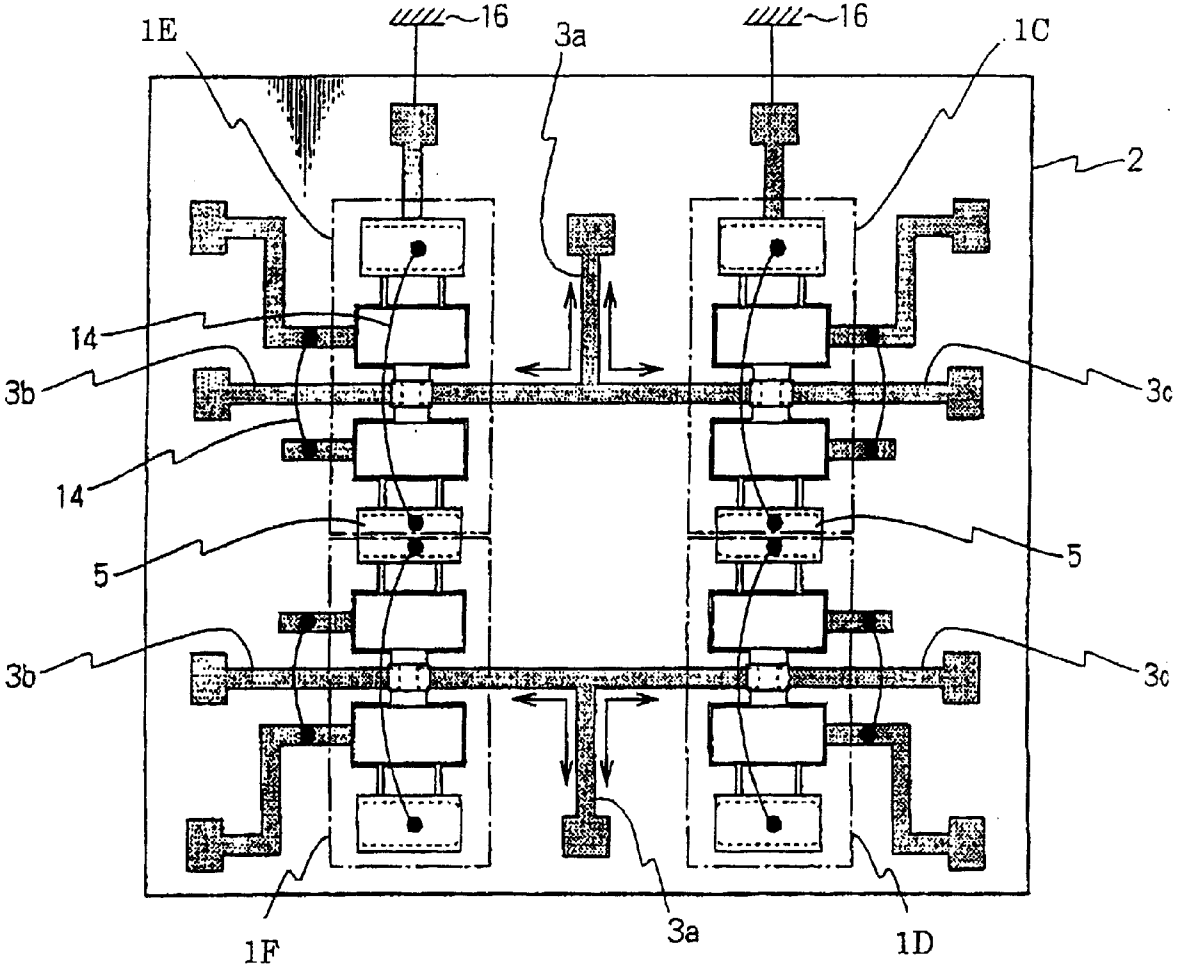
FIG. 8 is a plan view of a micro-machine switch in accordance with the third embodiment of the present invention.

FIG. 8 is a plan view of a micro-machine switch unit in accordance with the third embodiment.

The micro-machine switch unit is designed to include first to fourth micro-machine switches 1C, 1D, 1E and 1F. Each the first to fourth micro-machine switches 1C to 1F is designed to have the same structure as the structure of the micro-machine switch 1 illustrated in FIGS. 2, 3A and 3B. Similarly to the micro-machine switch unit 1S illustrated in FIG. 7, the micro-machine switch unit in accordance with the third embodiment includes pads and wires.

The micro-machine switch unit in accordance with the third embodiment is characterized in that a support 5 is commonly used by two micro-machine switches among the first to fourth micro-machine switches 1C, 1D, 1E and 1F. Specifically, a support 5 is used by both the first and second micro-machine switches 1C and 1D which are located adjacent to each other, and a support 5 is used by both the third and fourth micro-machine switches 1E and 1F which are located adjacent to each other.

This arrangement makes it possible to fabricate a product including the micro-machine switch unit smaller, and to reduce the number of wires to which a voltage is applied for driving a micro-machine switch.

Each of the first to fourth micro-machine switches 1C, 1D, 1E and 1F is operated by applying a voltage to the first and second lower electrodes 4L and 4R. Since the first and second upper electrodes 7L and 7R are electrically connected to the support 5 through the first and second resilient members 6L and 6R, the supports 5 in the first and second micro-machine switches 1C and 1D can be grounded, only if one of the supports 5 were grounded. Similarly, the supports 5 in the third and fourth micro-machine switches 1E and 1F can be grounded, only if one of the supports 5 were grounded.

Each of the first to fourth micro-machine switches 1C, 1D, 1E and 1F can be operated by applying a voltage to the first and second lower electrodes 4L and 4R in each of the first to fourth micro-machine switches 1C, 1D, 1E and 1F.

For instance, when the first micro-machine switch 1C is to be operated, a voltage is applied to the first and second lower electrodes 4L and 4R in the first micro-machine switch 1C. The other micro-machine switches 1D, 1E and 1F are not operated, because an electrostatic force is not generated.

Figure 9:
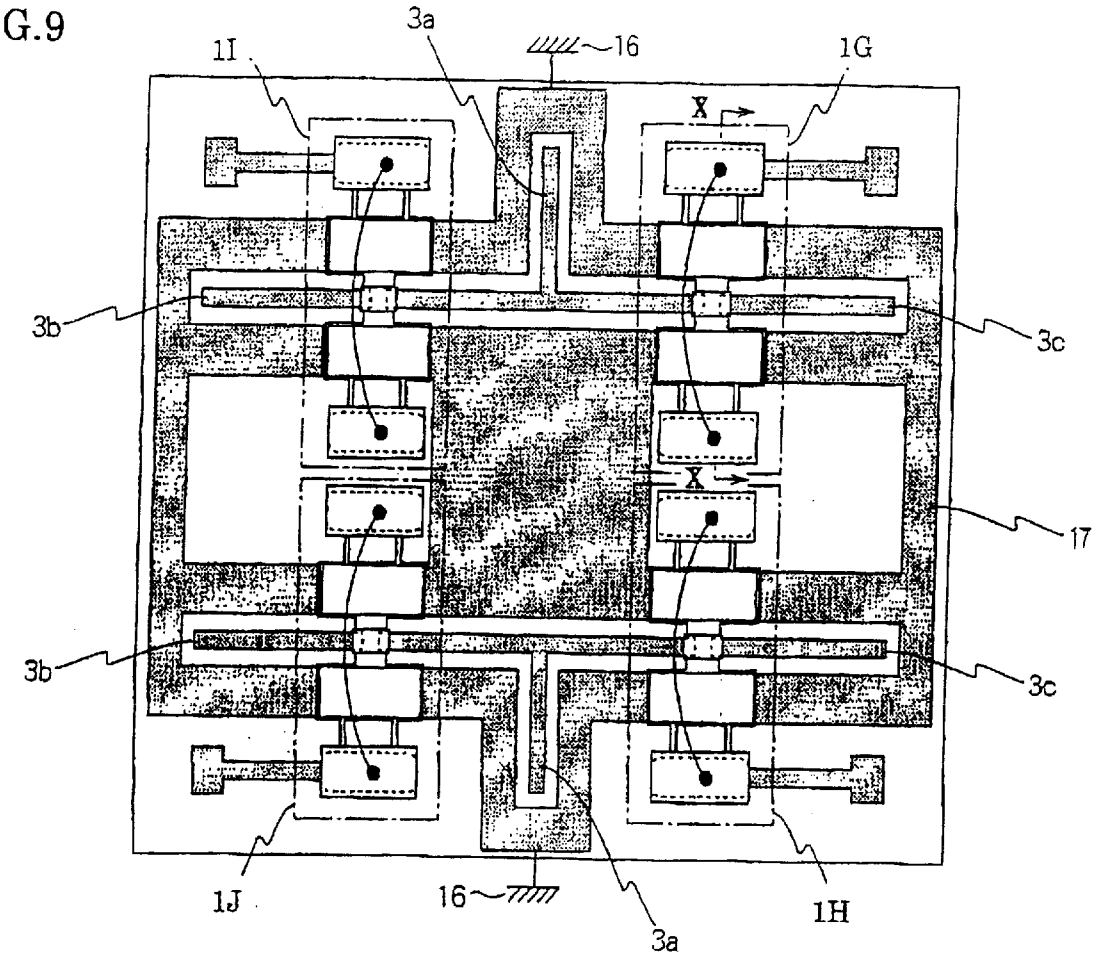
FIG. 9 is a plan view of a micro-machine switch in accordance with the fourth embodiment of the present invention.
Figure 10:
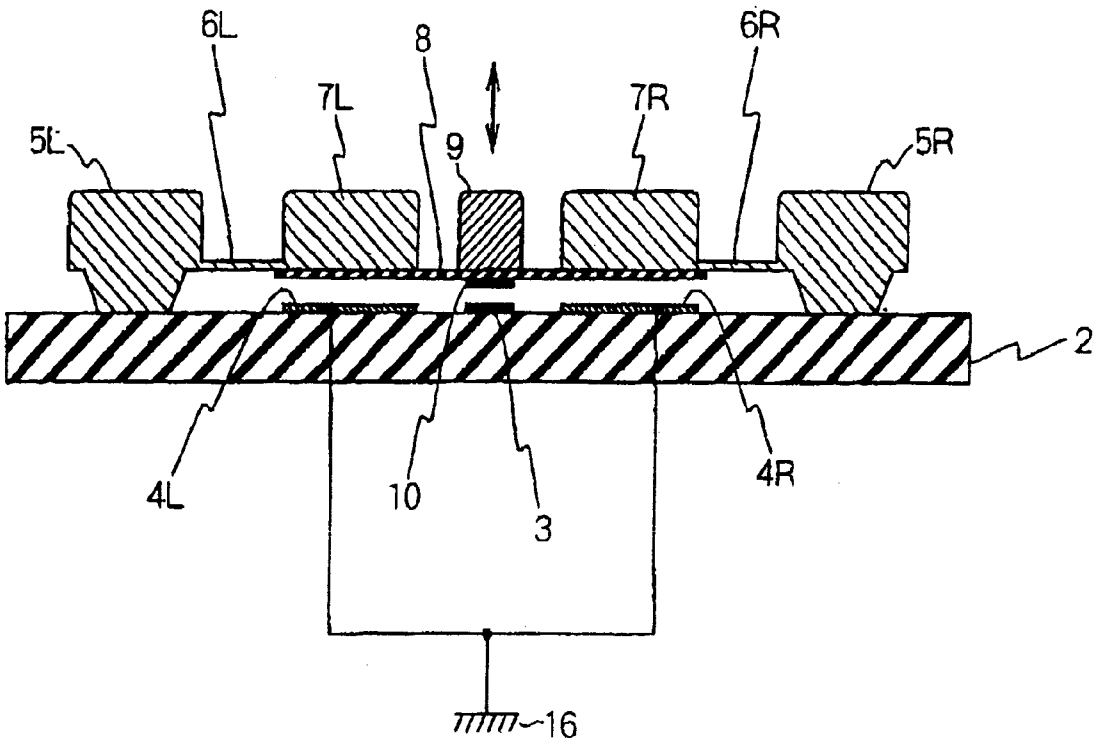
FIG. 10 is a cross-sectional view taken along the line X—X in FIG. 9.

FIG. 9 is a plan view of a micro-machine switch unit in accordance with the fourth embodiment. FIG. 10 is a cross-sectional view taken along the line X—X in FIG. 9.

The micro-machine switch unit is designed to include first to fourth micro-machine switches 1G, 1H, 1I and 1J. Each the first to fourth micro-machine switches 1G to 1J is designed to have the same structure as the structure of the micro-machine switch 1 illustrated in FIGS. 2, 3A and 3B. Similarly to the micro-machine switch unit 1S illustrated in FIG. 7, the micro-machine switch unit in accordance with the fourth embodiment includes pads and wires.

The micro-machine switch unit in accordance with the fourth embodiment is characterized in that the substrate has a grounded area 17 surrounding the common signal line 3*a* and the first and second signal lines 3*b* and 3*c*, and that the first and second lower electrodes 4L and 4R are electrically connected to the grounded area 17.

When the signal lines 3*a* to 3*c* are comprised of coplanar lines in order to transmit radio-frequency signals therethrough, it would be possible to reduce the number of wires through which a voltage is applied to the first and second lower electrodes 4L and 4R by forming the grounded area 17 surrounding the signal lines 3*a* to 3*c* and the first and second lower electrodes 4L and 4R integrally with each other. Since the first and second lower electrodes 4L and 4R are grounded, the first to fourth micro-machine switches 1G to 1J are driven by applying a voltage to the first and second upper electrodes 7L and 7R.

For instance, when the first micro-machine switch 1G is to be driven, a voltage is applied to the first and second supports 5L and 5R electrically connected to the first and second upper electrodes 7L and 7R through the first and second resilient members 6L and 6R in the first micro-machine switch 1G to thereby generate an electrostatic force between the first and second upper electrodes 7L and 7R and the first and second lower electrodes 4L and 4R.

The other micro-machine switches 1H to 1J are not driven, because a voltage is not applied to the first and second upper electrodes 7L and 7R, although the first and second lower electrodes 4L and 4R are grounded.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2000-073469 filed on Mar. 16, 2000 including specification, claims, drawings and summary is incorporated herein by reference in its entirety.

What is claimed is:

1. A micro-machine switch which causes a contact electrode to make contact with or separate away from a signal line formed on a substrate, to thereby turn on or off said signal line, comprising:

(a) first to N-th lower electrodes formed on said substrate, wherein N is an integer equal to or greater than 2;

(b) first to N-th upper electrodes supported on an insulating means facing said first to N-th lower electrodes, respectively; and (c) means for vertically raising and lowering said first to N-th upper electrodes between a first position where said contact electrode makes contact with said signal line when electrostatic force is generated between said first to N-th upper electrodes and said first to N-th lower electrodes, respectively, and a second position where said contact electrode is separated away from said signal line when said electrostatic force is not generated;

wherein said insulating means is isolated from said substrate.

2. The micro-machine switch as set forth in claim 1, wherein said first to N-th lower electrodes are located in symmetry about said signal line.

3. The micro-machine switch as set forth in claim 1, wherein said first to N-th upper electrodes are located in symmetry about said contact electrode.

4. A micro-machine switch which causes a contact electrode to make contact with or separate away from a signal line formed on a substrate, to thereby turn on or off said signal line, comprising:

(a) a first support formed on said substrate;

(b) a second support formed on said substrate at a distance away from said first support;

(c) a first upper electrode located between said first and second supports;

(d) a second upper electrode located between said first upper electrode and said second support;

(e) a first resilient member connecting said first support and said first upper electrode to each other such that said first upper electrode is kept floating above said substrate;

(f) a second resilient member connecting said second support and said second upper electrode to each other such that said second upper electrode is kept floating above said substrate;

(g) a first lower electrode formed on said substrate below said first upper electrode; and (h) a second lower electrode formed on said substrate below said second upper electrode, said contact electrode being supported on an insulating plate between said first and second upper electrodes, said insulating plate extending between said first resilient member and said second resilient member such that said contact electrode is floating above said substrate, said contact electrode being caused to make contact with said signal line when electrostatic force is generated between said first upper electrode and said first lower electrode and further between said second upper electrode and said second lower electrode, said contact electrode being separated away from said signal line due to restoring force generated by said first and second resilient members.

5. The micro-machine switch as set forth in claim 4, further comprising an electrical insulator extending between said first and second resilient members in parallel with said substrate, and having a first surface facing said substrate and a second surface not facing said substrate, said contact electrode being mounted on said first surface of said electrical insulator, said first and second upper electrodes being mounted on said second surface of said electrical insulator.

6. The micro-machine switch as set forth in claim 5, wherein said electrical insulator is in the form of a plate.

7. The micro-machine switch as set forth in claim 4, wherein at least a surface of said signal line is composed of ruthenium (Ru), rhodium (Rh) or gold cobalt.

8. The micro-machine switch as set forth in claim 4, wherein a first gap between said first upper electrode and said first lower electrode is equal to a second gap between said second upper electrode and said second lower electrode, and said first and second gaps are greater than a third gap between said contact electrode and said signal line.

9. The micro-machine switch as set forth in claim 4, wherein at least a surface of said contact electrode is composed of ruthenium (Ru), rhodium (Rh) or gold cobalt.

10. The micro-machine switch as set forth in claim 9, wherein said contact electrode is composed of gold except said surface.

11. The micro-machine switch as set forth in claim 4, wherein said substrate is composed of glass.

12. The micro-machine switch as set forth in claim 4, wherein said substrate is composed of silicon.

13. A micro-machine switch which causes a contact electrode to make contact with or separate away from a signal line formed on a substrate, to thereby turn on or off said signal line, comprising:

(a) a first support formed on said substrate;

(b) a second support formed on said substrate at a distance away from said first support;

(c) a first upper electrode located between said first and second supports;

(d) a second upper electrode located between said first upper electrode and said second support;

(e) a first resilient member connecting said first support and said first upper electrode to each other such that said first upper electrode is kept floating above said substrate;

(f) a second resilient member connecting said second support and said second upper electrode to each other such that said second upper electrode is kept floating above said substrate;

(g) a first lower electrode formed on said substrate below said first upper electrode; and (h) a second lower electrode formed on said substrate below said second upper electrode, said contact electrode being supported between said first and second upper electrodes such that said contact electrode is floating above said substrate, said contact electrode being caused to make contact with said signal line when electrostatic force is generated between said first upper electrode and said first lower electrode and further between said second upper electrode and said second lower electrode, said contact electrode being separated away from said signal line due to restoring force generated by said first and second resilient members, wherein said first and second upper electrodes are electrically connected to each other through a wire, and said first and second lower electrodes are electrically connected to each other through a wire.

14. A micro-machine switch unit comprising:

(a) a substrate;

(b) first to N-th micro-machine switches wherein N is an integer equal to or greater than 2; and (c) a common signal line and first to N-th signal lines all formed on said substrate, a K-th micro-machine switch electrically connecting said common signal line to a K-th signal line and electrically disconnecting said common signal line from a K-th signal line wherein K is an integer in the range of 1 to N both inclusive, each of said first to N-th micro-machine switches comprising:

(a1) a first support formed on said substrate;

(a2) a second support formed on said substrate at a distance away from said first support;

(a3) a first upper electrode located between said first and second supports;

(a4) a second upper electrode located between said first upper electrode and said second support;

(a5) a first resilient member connecting said first support and said first upper electrode to each other such that said first upper electrode is kept floating above said substrate;

(a6) a second resilient member connecting said second support and said second upper electrode to each other such that said second upper electrode is kept floating above said substrate;

(a7) a first lower electrode formed on said substrate below said first upper electrode; and (a8) a second lower electrode formed on said substrate below said second upper electrode, said contact electrode being supported between said first and second upper electrodes such that said contact electrode is floating above said substrate, said contact electrode being caused to make contact with said signal line when electrostatic force is generated between said first upper electrode and said first lower electrode and further between said second upper electrode and said second lower electrode, said contact electrode being separated away from said signal line due to restoring force generated by said first and second resilient members, wherein said first and second upper electrodes are electrically connected to each other through a wire, and said first and second lower electrodes are electrically connected to each other through a wire.

15. A method of fabricating a micro-machine switch comprising a first substrate, first and second supports standing on said first substrate, first and second upper electrodes located between said first and second supports, and first and second resilient members connecting said first and second supports to said first and second upper electrodes such that said first and second upper electrodes are kept floating above said first substrate, said method comprising the steps of:

(a) etching said first substrate in a selected area;

(b) forming a mask on said first substrate;

(c) diffusing an impurity into said first substrate in an area not covered with said mask, to thereby make a pattern of said first and second supports, said first and second upper electrodes, and said first and second resilient members;

(d) forming an electrical insulator on said first substrate such that said first and second upper electrodes are located on said electrical insulator;

(e) forming a contact electrode between said first and second upper electrodes;

(f) fixating said first substrate on a second substrate such that said first and second supports stand on said second substrate, a signal line being formed on said second substrate in alignment with said contact electrode, first and second lower electrodes being formed on said second substrate in alignment with said first and second upper electrodes, respectively; and (g) melting said first substrate except said area into which said impurity was diffused, wherein said first substrate is composed of a silicon and said second substrate is composed of ceramics or gallium arsenide (GaAs), and said first substrate is fixated to said second substrate through an adhesive.

16. A micro-machine switch which causes a contact electrode to make contact with or separate away from a signal line formed on a substrate, to thereby turn on or off said signal line, comprising:

(a) a first support formed on said substrate;

(b) a second support formed on said substrate at a distance away from said first support;

(c) a first upper electrode located between said first and second supports;

(d) a second upper electrode located between said first upper electrode and said second support;

(e) a first resilient member connecting said first support and said first upper electrode to each other such that said first upper electrode is kept floating above said substrate;

(f) a second resilient member connecting said second support and said second upper electrode to each other such that said second upper electrode is kept floating above said substrate;

(g) a first lower electrode formed on said substrate below said first upper electrode; and (h) a second lower electrode formed on said substrate below said second upper electrode, said contact electrode being supported between said first and second upper electrodes such that said contact electrode is floating above said substrate, said contact electrode being caused to make contact with said signal line when electrostatic force is generated between said first upper electrode and said first lower electrode and further between said second upper electrode and said second lower electrode, said contact electrode being separated away from said signal line due to restoring force generated by said first and second resilient members, wherein at least a surface of said signal line is composed of ruthenium (Ru), rhodium (Rh) or gold cobalt and said signal line is composed of gold except said surface.

17. A micro-machine switch which causes a contact electrode to make contact with or separate away from a signal line formed on a substrate, to thereby turn on or off said signal line, comprising:

(a) a first support formed on said substrate;

(b) a second support formed on said substrate at a distance away from said first support;

(c) a first upper electrode located between said first and second supports;

(d) a second upper electrode located between said first upper electrode and said second support;

(e) a first resilient member connecting said first support and said first upper electrode to each other such that said first upper electrode is kept floating above said substrate;

(f) a second resilient member connecting said second support and said second upper electrode to each other such that said second upper electrode is kept floating above said substrate;

(g) a first lower electrode formed on said substrate below said first upper electrode; and (h) a second lower electrode formed on said substrate below said second upper electrode, said contact electrode being supported between said first and second upper electrodes such that said contact electrode is floating above said substrate, said contact electrode being caused to make contact with said signal line when electrostatic force is generated between said first upper electrode and said first lower electrode and further between said second upper electrode and said second lower electrode, said contact electrode being separated away from said signal line due to restoring force generated by said first and second resilient members; and further comprising:

an electrical insulator extending between said first and second resilient members in parallel with said substrate, and having a first surface facing said substrate and a second surface not facing said substrate, said contact electrode being mounted on said first surface of said electrical insulator, said first and second upper electrodes being mounted on said surface of said electrical insulator; and a reinforcing plate mounted an said second surface of said electrical insulator between said first and second upper electrodes.

18. The micro-machine switch as set forth in claim 17, wherein said reinforcing plate has a larger area than an area of said contact electrode, and has a greater thickness than thicknesses of said contact electrode and said electrical insulator.

19. A micro-machine switch which causes a contact electrode to make contact with or separate away from a signal line formed on a substrate, to thereby turn on or off said signal line, comprising:

(a) a first support formed on said substrate;

(b) a second support formed on said substrate at a distance away from said first support;

(c) a first upper electrode located between said first and second supports;

(d) a second upper electrode located between said first upper electrode and said second support;

(e) a first resilient member connecting said first support and said first upper electrode to each other such that said first upper electrode is kept floating above said substrate;

(f) a second resilient member connecting said second support and said second upper electrode to each other such that said second upper electrode is kept floating above said substrate;

(g) a first lower electrode formed on said substrate below said first upper electrode; and (h) a second lower electrode formed on said substrate below said second upper electrode, (i) a first pad formed on said substrate and electrically connected to said first upper electrode through a wire; and (j) a second pad formed on said substrate and electrically connected to said second upper electrode through a wire;

said contact electrode being supported between said first and second upper electrodes such that said contact electrode is floating above said substrate, said contact electrode being caused to make contact with said signal line when electrostatic force is generated between said first upper electrode and said first lower electrode and further between said second upper electrode and said second lower electrode, said contact electrode being separated away from said signal line due to restoring force generated by said first and second resilient members.

20. The micro-machine switch as set forth in claim 19, further comprising:

a third pad formed on said substrate and electrically connected to said first lower electrode through a wire; and a fourth pad formed on said substrate and electrically connected to said second lower electrode through a wire.

21. A micro-machine switch unit comprising:

(a) a substrate;

(b) first to N-th micro-machine switches wherein N is an integer equal to or greater than 2; and (c) a common signal line and first to N-th signal lines all formed on said substrate, a K-th micro-machine switch electrically connecting said common signal line to a K-th signal line and electrically disconnecting said common signal line from a K-th signal line wherein K is an integer in the range of 1 to N both inclusive, each of said first to N-th micro-machine switches comprising:

(a1) a first support formed on said substrate;

(a2) a second support formed on said substrate at a distance away from said first support;

(a3) a first upper electrode located between said first and second supports;

(a4) a second upper electrode located between said first upper electrode and said second support;

(a5) a first resilient member connecting said first support and said first upper electrode to each other such that said first upper electrode is kept floating above said substrate;

(a6) a second resilient member connecting said second support and said second upper electrode to each other such that said second upper electrode is kept floating above said substrate;

(a7) a first lower electrode formed on said substrate below said first upper electrode; and (a8) a second lower electrode formed on said substrate below said second upper electrode, said contact electrode being supported on an insulating plate between said first and second upper electrodes, said insulating plate extending between said first resilient member and said second resilient member such that said contact electrode is floating above said substrate, said contact electrode being caused to make contact with said signal line when electrostatic force is generated between said first upper electrode and said first lower electrode and further between said second upper electrode and said second lower electrode, said contact electrode being separated away from said signal line due to restoring force generated by said first and second resilient members.

22. The micro-machine switch unit as set forth in claim 21, wherein each of said first to N-th micro-machine switches further includes an electrical insulator extending between said first and second resilient members in parallel with said substrate, and having a first surface facing said substrate and a second surface not facing said substrate, said contact electrode being mounted on said first surface of said electrical insulator, said first and second upper electrodes being mounted on said second surface of said electrical insulator.

23. The micro-machine switch unit as set forth in claim 22, wherein said electrical insulator is in the form of a plate.

24. The micro-machine switch unit as set forth in claim 21, wherein said substrate is composed of glass.

25. The micro-machine switch unit as set forth in claim 21, wherein said substrate is composed of silicon.

26. The micro-machine switch unit as set forth in claim 21, wherein at least a surface of said signal line is composed of ruthenium (Ru), rhodium (Rh) or gold cobalt.

27. The micro-machine switch unit as set forth in claim 21, wherein a first gap between said first upper electrode and said first lower electrode is equal to a second gap between said second upper electrode and said second lower electrode, and said first and second gaps are greater than a third gap between said contact electrode and said signal line.

28. The micro-machine switch unit as set forth in claim 21, wherein said first or second support on one of said first to N-th micro-machine switches is commonly used by at least two micro-machine switches among said first to N-th micro-machine switches.

29. The micro-machine switch unit as set forth in claim 21, wherein at least a surface of said contact electrode is composed of ruthenium (Ru), rhodium (Rh) or gold cobalt.

30. The micro-machine switch unit as set forth in claim 29, wherein said contact electrode is composed of gold except said surface.

31. A micro-machine switch which causes a contact electrode to make contact with or separate away from a signal line formed on a substrate, to thereby turn on or off said signal line, comprising:

(a) a first support formed on said substrate;

(b) a second support formed on said substrate at a distance away from said first support;

(c) a first upper electrode located between said first and second supports;

(d) a second upper electrode located between said first upper electrode and said second support;

(e) a first resilient member connecting said first support and said first upper electrode to each other such that said first upper electrode is kept floating above said substrate;

(f) a second resilient member connecting said second support and said second upper electrode to each other such that said second upper electrode is kept floating above said substrate;

(g) a first lower electrode formed on said substrate below said first upper electrode; and (h) a second lower electrode formed on said substrate below said second upper electrode, said contact eletrode being supported between said first and second upper electrodes such that said contact electrode is floating above said substrate, said contact electrode being caused to make contact with said signal line when electrostatic force is generated between said first upper electrode and said first lower electrode and further between said second upper electrode and said second lower electrode, said contact electrode being separated away from said signal line due to restoring force generated by said first and second resilient members, wherein said substrate has a grounded area surrounding said signal line, said grounded area being electrically connected to said first and second lower electrodes.

32. The micro-machine switch as set forth in claim 31, wherein said grounded area surrounds said signal line at a constant distance therebetween.

33. A micro-machine switch unit comprising:

(a) a substrate;

(b) first to N-th micro-machine switches wherein N is an integer equal to or greater than 2; and (c) a common signal line and first to N-th signal lines all formed on said substrate, a K-th micro-machine switch electrically connecting said common signal line to a K-th signal line and electrically disconnecting said common signal line from a K-th signal line wherein K is an integer in the range of 1 to N both inclusive, each of said first to N-th micro-machine switches comprising:

(a1) a first support formed on said substrate;

(a2) a second support formed on said substrate at a distance away from said first support;

(a3) a first upper electrode located between said first and second supports;

(a4) a second upper electrode located between said first upper electrode and said second support;

(a5) a first resilient member connecting said first support and said first upper electrode to each other such that said first upper electrode is kept floating above said substrate;

(a6) a second resilient member connecting said second support and said second upper electrode to each other such that said second upper electrode is kept floating above said substrate;

(a7) a first lower electrode formed on said substrate below said first upper electrode; and (a8) a second lower electrode formed on said substrate below said second upper electrode, said contact electrode being supported between said first and second upper electrodes such that said contact electrode is floating above said substrate, said contact electrode being caused to make contact with said signal line when electrostatic force is generated between said first upper electrode and said first lower electrode and further between said second upper electrode and said second lower electrode, said contact electrode being separated away from said signal line due to restoring force generated by said first and second resilient members, wherein at least a surface of said signal line is composed of ruthenium (Ru), rhodium (Rh) or gold cobalt and said signal line is composed of gold except said surface.

34. A micro-machine switch unit comprising:

(a) a substrate;

(b) first to N-th micro-machine switches wherein N is an integer equal to or greater than 2; and (c) a common signal line and first to N-th signal lines all formed on said substrate, a K-th micro-machine switch electrically connecting said common signal line to a K-th signal line and electrically disconnecting said common signal line from a K-th signal line wherein K is an integer in the range of 1 to N both inclusive, each of said first to N-th micro-machine switches comprising:

(a1) a first support formed on said substrate;

(a2) a second support formed on said substrate at a distance away from said first support;

(a3) a first upper electrode located between said first and second supports;

(a4) a second upper electrode located between said first upper electrode and said second support;

(a5) a first resilient member connecting said first support and said first upper electrode to each other such that said first upper electrode is kept floating above said substrate;

(a6) a second resilient member connecting said second support and said second upper electrode to each other such that said second upper electrode is kept floating above said substrate;

(a7) a first lower electrode formed on said substrate below said first upper electrode; and (a8) a second lower electrode formed on said substrate below said second upper electrode, said contact electrode being supported between said first and second upper electrodes such that said contact electrode is floating above said substrate, said contact electrode being caused to make contact with said signal line when electrostatic force is generated between said first upper electrode and said first lower electrode and further between said second upper electrode and said second lower electrode, said contact electrode being separated away from said signal line due to restoring force generated by said first and second resilient members, and further comprising a reinforcing plate mounted on said second surface of said electrical insulator between said first and second upper electrodes.

35. The micro-machine switch unit as set forth in claim 34, wherein said reinforcing plate has a larger area than an area of said contact electrode, and has a greater thickness than thicknesses of said contact electrode and said electrical insulator.

36. A micro-machine switch unit comprising:

(a) a substrate;

(b) first to N-th micro-machine switches wherein N is an integer equal to or greater than 2; and (c) a common signal line and first to N-th signal lines all formed on said substrate, a K-th micro-machine switch electrically connecting said common signal line to a K-th signal line and electrically disconnecting said common signal line from a K-th signal line wherein K is an integer in the range of 1 to N both inclusive, each of said first to N-th micro-machine switches comprising:

(a1) a first support formed on said substrate;

(a2) a second support formed on said substrate at a distance away from said first support;

(a3) a first upper electrode located between said first and second supports;

(a4) a second upper electrode located between said first upper electrode and said second support;

(a5) a first resilient member connecting said first support and said first upper electrode to each other such that said first upper electrode is kept floating above said substrate;

(a6) a second resilient member connecting said second support and said second upper electrode to each other such that said second upper electrode is kept floating above said substrate;

(a7) a first lower electrode formed on said substrate below said first upper electrode; and (a8) a second lower electrode formed on said substrate below said second upper electrode, said contact electrode being supported between said first and second upper electrodes such that said contact electrode is floating above said substrate, said contact electrode being caused to make contact with said signal line when electrostatic force is generated between said first upper electrode and said first lower electrode and further between said second upper electrode and said second lower electrode, said contact electrode being separated away from said signal line due to restoring force generated by said first and second resilient members, said substrate having a grounded area surrounding said signal line, said grounded area being electrically connected to said first and second lower electrodes.

37. The micro-machine switch unit as set forth in claim 36, wherein said grounded area surrounds said signal line at a constant distance therebetween.

38. A micro-machine switch unit comprising:

(a) a substrate;

(b) first to N-th micro-machine switches wherein N is an integer equal to or greater than 2; and (c) a common signal line and first to N-th signal lines all formed on said substrate, a K-th micro-machine switch electrically connecting said common signal line to a K-th signal line and electrically disconnecting said common signal line from a K-th signal line wherein K is an integer in the range of 1 to N both inclusive, each of said first to N-th micro-machine switches comprising:

(a1) a first support formed on said substrate;

(a2) a second support formed on said substrate at a distance away from said first support;

(a3) a first upper electrode located between said first and second supports;

(a4) a second upper electrode located between said first upper electrode and said second support;

(a5) a first resilient member connecting said first support and said first upper electrode to each other such that said first upper electrode is kept floating above said substrate;

(a6) a second resilient member connecting said second support and said second upper electrode to each other such that said second upper electrode is kept floating above said substrate;

(a7) a first lower electrode formed on said substrate below said first upper electrode;

(a8) a second lower electrode formed on said substrate below said second upper electrode;

(a9) a first pad formed on said substrate and electrically connected to said first upper electrode through a wire; and (a10) a second pad formed on said substrate and electrically connected to said second upper electrode through a wire;

said contact electrode being supported between said first and second upper electrodes such that said contact electrode is floating above said substrate, said contact electrode being caused to make contact with said signal line when electrostatic force is generated between said first upper electrode and said first lower electrode and further between said second upper electrode and said second lower electrode, said contact electrode being separated away from said signal line due to restoring force generated by said first and second resilient members.

39. The micro-machine switch unit as set forth in claim 38, wherein each of said first to N-th micro-machine switches further includes:

a third pad formed on said substrate and electrically connected to said first lower electrode through a wire; and a fourth pad formed on said substrate and electrically connected to said second lower electrode through a wire.

40. A method of fabricating a micro-machine switch comprising a first substrate, first and second supports standing on said first substrate, first and second upper electrodes located between said first and second supports, and first and second resilient members connecting said first and second supports to said first and second upper electrodes such that said first and second upper electrodes are kept floating above said first substrate, said method comprising the steps of:

(a) etching said first substrate in a selected area;

(b) forming a mask on said first substrate;

(c) diffusing an impurity into said first substrate in an area not covered with said mask, to thereby make a pattern of said first and second supports, said first and second upper electrodes, and said first and second resilient members;

(d) forming an electrical insulator on said first substrate such that said first and second upper electrodes are located on said electrical insulator;

(e) forming a contact electrode between said first and second upper electrodes;

(f) fixating said first substrate on a second substrate such that said first and second supports stand on said second substrate, a signal line being formed on said second substrate in alignment with said contact electrode, first and second lower electrodes being formed on said second substrate in alignment with said first and second upper electrodes, respectively; and (g) melting said first substrate except said area into which said impurity was diffused.

41. The method as set forth in claim 40, wherein a pattern of a reinforcing plate is also made in said step (c), said reinforcing plate being mounted on said electrical conductor between said first and second upper electrodes in a final product.

42. The method as set forth in claim 41, wherein said first substrate is fixated to said second substrate in said step (f) by electrostatic bonding.

* * * * *